US007829254B2

(12) United States Patent
Kurose et al.

(10) Patent No.: US 7,829,254 B2
(45) Date of Patent: Nov. 9, 2010

(54) NON-MAGNETIC TONER, IMAGE FORMING APPARATUS AND PROCESS CARTRIDGE

(75) Inventors: Katsunori Kurose, Takarazuka (JP); Chiyoshi Nozaki, Otsu (JP); Tsuyoshi Nozaki, Ikeda (JP); Atsushi Yamamoto, Kawanishi (JP); Mitsuyo Matsumoto, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 895 days.

(21) Appl. No.: 11/687,352

(22) Filed: Mar. 16, 2007

(65) Prior Publication Data

US 2007/0218388 A1 Sep. 20, 2007

(30) Foreign Application Priority Data

Mar. 16, 2006 (JP) ..... 2006-073399

(51) Int. Cl.
*G03G 9/00* (2006.01)

(52) U.S. Cl. ..... 430/108.7; 430/109.4; 430/110.2; 399/252

(58) Field of Classification Search ..... 430/108.7, 430/109.4, 110.2; 399/252
See application file for complete search history.

(56) References Cited

U.S. PATENT DOCUMENTS

| | | | |
|---|---|---|---|
| 2006/0040194 | A1 | 2/2006 | Sugiura et al. |
| 2006/0204882 | A1 | 9/2006 | Nozaki et al. |
| 2006/0210902 | A1 | 9/2006 | Nakamura et al. |
| 2006/0275686 | A1 | 12/2006 | Kadota et al. |

FOREIGN PATENT DOCUMENTS

| | | |
|---|---|---|
| JP | 9-179336 | 7/1997 |
| JP | 11-305478 | 11/1999 |
| JP | 3195362 | 6/2001 |
| JP | 2002-116574 | 4/2002 |
| JP | 2004-109848 | 4/2004 |
| JP | 2004-246345 | 9/2004 |
| JP | 2004-271638 | 9/2004 |
| JP | 2004-295105 | 10/2004 |
| JP | 2004-310018 | 11/2004 |
| JP | 2005-234410 | 9/2005 |
| JP | 3724309 | 9/2005 |
| WO | WO 97/01131 | 1/1997 |

OTHER PUBLICATIONS

U.S. Appl. No. 12/017,853, filed Jan. 22, 2008, Masumoto, et al.
U.S. Appl. No. 12/026,057, filed Feb. 5, 2008, Nozaki, et al.

(Continued)

*Primary Examiner*—Mark A Chapman
(74) *Attorney, Agent, or Firm*—Oblon, Spivak, McClelland, Maier & Neustadt, L.L.P.

(57) ABSTRACT

The present invention aims at providing non-magnetic toner which is excellent in fixing property and charge property and capable of inhibiting occurrence of scumming, as well as an image forming apparatus and a process cartridge using the non-magnetic toner.

A non-magnetic toner comprising: a toner base particle which comprises a binding resin, and a colorant; and external additives, wherein a surface of the toner base particle contains at least a resin having at least silanol group, and the external additives contain at least particles composed of silicon oxide.

20 Claims, 3 Drawing Sheets

OTHER PUBLICATIONS

U.S. Appl. No. 12/035,892, filed Feb. 22, 2008, Kadota, et al.
U.S. Appl. No. 12/046,784, filed Mar. 12, 2008, Nozaki, et al.
U.S. Appl. No. 12/046,866, filed Mar. 12, 2008, Matsumoto, et al.
U.S. Appl. No. 12/048,689, filed Mar. 14, 2008, Kadota, et al.
U.S. Appl. No. 12/049,719, filed Mar. 17, 2008, Yamamoto, et al.
U.S. Appl. No. 12/050,963, filed Mar. 19, 2008, Ishikawa, et al.
U.S. Appl. No. 12/046,869, filed Mar. 12, 2008, Nozaki, et al.
U.S. Appl. No. 12/172,378, filed Jul. 14, 2008, Yamamoto, et al.

NON-MAGNETIC TONER, IMAGE FORMING APPARATUS AND PROCESS CARTRIDGE

BACKGROUND OF THE INVENTION

1. Field of the Invention

The present invention relates to non-magnetic toner, an image forming apparatus and a process cartridge.

2. Description of the Related Art

Conventionally, as fixing systems of the toner, contact heating fixing systems such as heat roll fixing system are widely employed. A fixing apparatus employed for the heat roll fixing system comprises a heating roll and a pressurizing roll. A toner image is melted to fix on a recording sheet by passing the recording sheet bearing the toner image through a pressure welding section (nip section) between the heating roll and the pressurizing roll.

In the contact heating fixing system typified by the heat roll fixing system, the fixing is performed by contacting a surface of a heating member (e.g., heating roll) in the contact heating fixing apparatus with the toner image. Thus, it is necessary to prevent an offset phenomenon that a part of the toner image adheres to the heating member and transfers onto a subsequent recording sheet to stain the sheet.

For preventing the offset phenomenon, technology in which a fixing oil such as silicone oil is applied to or impregnated in the heating roll and the pressurizing roll in the fixing apparatus has been known. However, in terms of downsizing and reducing cost of the fixing apparatus, oilless fixing apparatuses omitting a fixing oil imparting mechanism or fixing apparatuses in which an amount of the fixing oil to be applied has been reduced are employed. When such a fixing apparatus is employed, a releasing agent as an anti-offset agent is added to the toner.

In the case of the heating fixing system, to save energy, it is more preferable that a heating temperature is lower as possible. However, in order to accomplish this, when a thermal property of a binding resin is designed to be too low, a heat resistant storage stability is deteriorated and blocking and the like occur. In order to balance them, it is advantageous to use a polyester resin for the binding resin. The polyester resin has lower viscosity and higher elasticity than vinyl based copolymer resins, and is excellent in fixing property at low temperature and good in heat resistant storage stability.

However, when the toner in which the sufficient amount of the releasing agent has been added for preventing the offset is produced by a conventional pulverization method, the releasing agent is abundantly exposed on the surface of the toner, resulting in the occurrence of filming and blocking. Meanwhile, when the toner is produced by so-called polymerization methods such as suspension polymerization (see Japanese Patent No. 3195362) in which a polymerizable monomer is polymerized in a water-based medium or emulsification polymerization (see Japanese Patent Application Laid-Open (JP-A) No. 2002-116574) in which fine particles are previously made by the emulsification polymerization and then aggregated, the sufficient amount of the releasing agent can be relatively enfolded, but the polymerization is performed in the water-based medium in the suspension polymerization and the emulsification polymerization. Thus, the vinyl based copolymer resins are generally used, and it is difficult to use the polyester resin polymerized at high temperature of about 200° C. or above.

As the method for granulating the toner using the polyester resin, a so-called dissolution suspension method in which the previously polymerized resin is dissolved in an organic solvent and granulated in the water-based medium is known. In this method, a molecular weight of the starting resin directly corresponds to the molecular weight of the toner. To control the thermal property of the toner, it is common to mix a low molecular weight resin and a high molecular weight resin to use. However, when the high molecular weight resin is added, the viscosity of the solution becomes too high, resulting in deterioration of granulability. Thus, the high molecular weight resin can not be used. Therefore, there is no other choice than making the molecular weight of the low molecular weight resin set higher, and this is disadvantageous to the fixing at low temperature.

Thus, there is the method in which modified polyester having a reactive functional group is used in place of the high molecular weight resin, and the molecular weight is controlled by performing an extending and/or crosslinking reaction after the granulation. When this method is used, it becomes possible to control the thermal property of the toner, but it is insufficient to control the toner structure, and a colorant and the releasing agent are easily exposed on the toner surface. When the colorant is exposed on the surface, a charging performance of the toner is changed. In particular, the narrower a particle diameter distribution is, the effect tends to become more remarkable. The releasing agent is exposed more abundantly on the surface, this is more advantageous to the fixing property, but problems occur in development durability, member staining such as filming and thermal stability. In particular, when the releasing agent having the low viscosity is used, the effect is remarkable, and for example oxidation affects dispersibility and charge property.

Meanwhile, when silicon oxide ($SiO_2$) is used as a major ingredient of an externally adding agent, it is known that the charge property of the toner is changed by burying it in the toner surface.

BRIEF SUMMARY OF THE INVENTION

In the light of the above problems that the conventional technology has, the present invention aims at providing non-magnetic toner which is excellent in fixing property and charge property and can inhibit occurrence of scumming, as well as an image forming apparatus and a process cartridge using the non-magnetic toner.

The invention according to claim 1 is a non-magnetic toner comprising:

a toner base particle which comprises a binding resin, and a colorant; and external additives, wherein a surface of the toner base particle contains at least a resin having at least silanol group, and the external additives contain at least particles composed of silicon oxide.

The invention according to claim 2 is the non-magnetic toner according to claim 1, wherein the surface of said toner base particle is formed by aggregating and/or fusion-bonding said particles containing the resin having at least the silanol group.

The invention according to claim 3 is the non-magnetic toner according to claim 1, wherein said toner base particle has a core material containing at least the colorant and a first binding resin, and a shell material covering the core material and composed of a second binding resin, and wherein the second binding resin contains at least said resin having at least the silanol group.

The invention according to claim 4 is the non-magnetic toner according to claim 1, wherein said silanol group is obtained by chemically treating a functional group represented by a general formula:

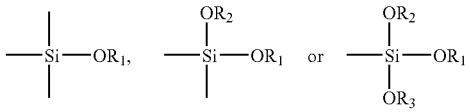

wherein $R_1$, $R_2$ and $R_3$ are each independently hydrocarbon groups selected from the group consisting of branched or straight alkyl groups having 1 to 6 carbon atoms, alicyclic groups having 3 to 6 carbon atoms and substituted or unsubstituted phenyl groups.

The invention according to claim 5 is the non-magnetic toner according to claim 4, wherein in said shell material, a film thickness is 20 nm or more and 300 nm or less, a volume average particle diameter is 4 μm or more and 10 μm or less, and an average circularity is 0.910 or more and 0.990 or less.

The invention according to claim 6 is the non-magnetic toner according to claim 4, wherein said first binding resin contains polyester resin having a glass transition temperature of 40° C. or above and 80° C. or below.

The invention according to claim 7 is the non-magnetic toner according to claim 4, wherein said first binding resin contains modified polyester resin.

The invention according to claim 8 is the non-magnetic toner according to claim 7, wherein said modified polyester resin has urethane group and/or urea group.

The invention according to claim 9 is the non-magnetic toner according to claim 4, wherein said first binding resin contains a resin obtained by reacting the polyester resin having isocyanate group at an end with amines.

The invention according to claim 10 is the non-magnetic toner according to claim 1, wherein said toner base particle has a surface tension of 30 mN/m or more and 60 mN/m or less.

The invention according to claim 11 is the non-magnetic toner according to claim 1, wherein said toner base particle is obtained by at least being granulated using an organic solvent in a water-based medium and subsequently removing the organic solvent.

The invention according to claim 12 is the non-magnetic toner according to claim 1, wherein said toner base particle is obtained by at least granulating in a water-based medium, subsequently washing using the water-based medium and further drying.

The invention according to claim 13 is the non-magnetic toner according to claim 1, further containing a releasing agent.

The invention according to claim 14 is the non-magnetic toner according to claim 1, further containing a charge controlling agent.

The invention according to claim 15 is the non-magnetic toner according to claim 1, used for a one-component development system.

The invention according to claim 16 is an image forming apparatus, wherein an image is formed using non-magnetic toner comprising:

a toner base particle which comprises a binding resin, and a colorant; and external additives wherein a surface of the toner base particle contains at least a resin having at least silanol group, and the external additives contain at least particles composed of silicon oxide.

The invention according to claim 17 is an image forming apparatus according to claim 16, wherein a multicolor image is formed.

The invention according to claim 18 is an image forming apparatus according to claim 16, having an endless type of an intermediate transferring unit.

The invention according to claim 19 is an image forming apparatus according to claim 18, having a photoconductor and a cleaning unit which cleans the toner left on the photoconductor and/or said intermediate transferring unit, wherein the cleaning unit has no cleaning blade.

The invention according to claim 20 is an image forming apparatus according to claim 18, having a photoconductor and a cleaning unit which cleans the toner left on the photoconductor and/or said intermediate transferring unit, wherein the cleaning unit has a cleaning blade.

The invention according to an embodiment is an image forming apparatus having a fixing unit which fixes an image using a roller having a heating apparatus.

The invention according to an embodiment is an image forming apparatus having a fixing unit which fixes an image using a belt having a heating apparatus.

The invention according to an embodiment is an image forming apparatus having a fixing unit which requires no oil application for a fixing member.

The invention according to an embodiment is a process cartridge integrally supporting a photoconductor and a developing unit which develops using non-magnetic toner comprising:

a toner base particle which comprises a binding resin, and a colorant; and external additives wherein a surface of the toner base particle contains at least a resin having at least silanol group, and the external additives contain at least particles composed of silicon oxide;

and being detachable to an image forming apparatus main body.

According to the present invention, it is possible to provide the non-magnetic toner which is excellent in fixing property and charge property and can inhibit the occurrence of scumming, as well as the image forming apparatus and the process cartridge using the non-magnetic toner.

DETAILED DESCRIPTION OF THE INVENTION

Figure 1:
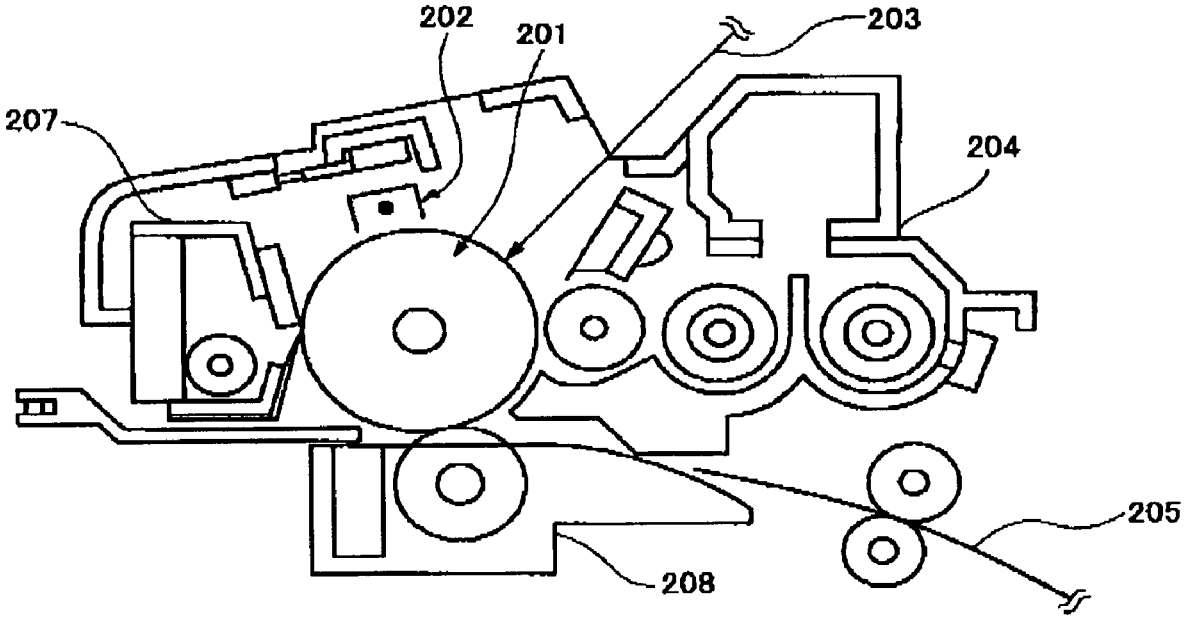
FIG. 1 is a view showing one example of a process cartridge of the present invention.

Subsequently, best modes for carrying out the present invention will be described.

The non-magnetic toner (hereinafter referred to as the toner) of the present invention has toner base particles containing at least a colorant and a binding resin, and an externally adding agent, the surface of the toner base particles contains at least a resin having at least a silanol group, and the externally adding agent contains at least particles composed of silicon oxide.

When silicon oxide ($SiO_2$) is used as the major ingredient of the externally adding agent, it is known that the charge property of the toner is changed by burying it in the toner surface. It is thought to be because silicon oxide highly contributes to the charge property of the toner base particle and its effect is gradually converged. When the charge property of the base particle and the charge property of the externally adding agent are more largely different, this effect becomes larger. In particular, it is thought that the relation of materials and properties composing the surface of the toner base particles with the externally adding agent largely affects the charge property. Furthermore, when the undeteriorated toner is mixed with the deteriorated toner, the distribution of charge amounts tends to become broad.

For such problems, as a result of an extensive study on the relation of the surface of the toner base particle with the externally adding agent, it has been found that the change of the charge property with the change of an adhering state of the externally adding agent is remarkably improved by containing the resin having the silanol group similar to silicon oxide used for the externally adding agent in the surface of the toner base particle. At that time, it is more preferable that the difference of the charge property between the base particle and the externally adding agent is small.

In the present invention, it is preferable that the toner base particle has the core material containing at least the colorant and the binding resin (A) and the shell material covering the core material and composed of the binding resin (B) and that the binding resin (B) contains at least the resin having at least the silanol group. This can narrow the distribution of the charge amounts of the toner base particle attributed to the colorant and the releasing agent, which is remarkable in multicolor development, and enhances versatility as a procedure of functional separation of toner properties by structural control. Furthermore, by making the shell material suppressing the difference of the charge property from the externally adding agent, it becomes possible to suppress the change of the toner charge property with time and form the stable image.

The silanol group is typically obtained by chemically treating alkoxysilyl group, and it is preferable to obtain by chemically treating the functional group represented by the general formula:

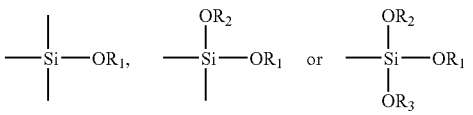

wherein $R_1$, $R_2$ and $R_3$ are each independently hydrocarbon groups selected from the group consisting of branched or straight alkyl groups having 1 to 6 carbon atoms, alicyclic groups having 3 to 6 carbon atoms and substituted or unsubstituted phenyl groups.

The resin having at least the silanol group is not particularly limited, and in order to cover the surface of the toner base particle, a glass transition temperature is typically 40° C. to 80° C. and preferably 45° C. to 70° C.

In the present invention, since the toner base particle easily makes the silanol group present in the vicinity of the surface, it is preferable to granulate in the water-based medium.

In the present invention, a film thickness of the shell material is preferably 20 nm to 300 nm, more preferably 20 nm to 250 nm and particularly preferably 30 nm to 200 nm. When the film thickness of the shell material is less than 10 nm, the effect of the colorant on the charge property is not sometimes alleviated sufficiently. The charge property is sometimes easily changed by burying the externally adding agent. Meanwhile, when the film thickness of the shell material exceeds 300 nm, the releasing agent is permeated insufficiently and the fixing property (separability, strength) is sometimes reduced.

A volume average particle diameter of the toner is preferably 4 μm to 10 μm. When the volume average particle diameter is smaller than 4 μm, troubles sometimes occur in each process of the image formation. When it is larger than 10 μm, resolution of the image is sometimes reduced.

An average circularity of the toner is preferably 0.910 to 0.990, more preferably 0.930 to 0.990 and particularly preferably 0.950 to 0.990. When the average circularity is less than 0.910, variation in the charge distribution in the toner easily occurs, and a transfer efficiency and a dot reproducibility are sometimes reduced. When it exceeds 0.990, if the charge property is reduced due to durability, it becomes difficult to retain the toner on the bearing member, and the scumming and feeding defect easily occur. When a cleaning system is mounted, unwiped toner left after the transfer is easily sometimes produced.

In the present invention, it is preferable that the toner base particle has a surface tension of 30 mN/m to 60 mN/m. When the surface tension is smaller than 30 mN/m, the amount of the silanol group introduced is insufficient, and a polarity of the surface becomes sometimes small. When it is larger than 60 mN/m, affinity with water is too high, and it becomes sometimes difficult to assure the charge property under a high humidity environment.

In the present invention, the binding resin (A) includes polystyrene, polymers of styrene and substituents thereof such as poly(p-chlorostyrene) and polyvinyl toluene; styrene based copolymers such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene octyl acrylate copolymers, styrene-methyl methacrylate copolymers, styrene-ethyl methacrylate copolymers, styrene butyl methacrylate copolymers, styrene-methyl α-chloro-methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleate ester copolymers; methyl polymethacrylate, butyl polymethacrylate, polyvinyl chloride, polyvinyl acetate, polyethylene, polypropylene, polyester resins, epoxy resins, epoxy polyol resins, polyurethane, polyamide, polyvinyl butyral, polyacrylic acid resins, rosin, modified rosin, terpene resins, aliphatic or alicyclic hydrocarbon resins, aromatic petroleum resins, chlorinated paraffin and paraffin wax. These may be used alone or in mixture. Among them, the polyester resin is preferable.

In the present invention, the polyester resin is not particularly limited and any of them can be used. Several types of the polyester resins may be mixed to use. The polyester resins include, for example, the following polycondensates of polyol (1) and polycarboxylic acid (2).

Polyol (1) includes alkylene glycol (ethylene glycol, 1,2-propylene glycol, 1,3-propylene glycol, 1,4-butanediol, 1,6-hexanediol); alkylene ether glycol (diethylene glycol, triethylene glycol, dipropylene glycol, polyethylene glycol, polypropylene glycol, polytetramethylene glycol); alicyclic diol (1,4-cyclohexane dimethanol, hydrogenated bisphenol A); bisphenols (bisphenol A, bisphenol F, bisphenol S, 4,4'-dihydroxyphenyls such as 3,3'-difluoro-4,4'-dihydroxyphenyl; bis(4-hydroxyphenyl)alkanes such as bis(3-fluoro-4-hydroxyphenyl)methane, 1-phenyl-1,1-bis(3-fluoro-4-hydroxyphenyl)ethane, 2,2-bis (3-fluoro-4-hydroxyphenylpropane, 2,2-bis(3,5-difluoro-4-hydroxyphenyl)propane (another name: tetrafluorobisphenol A) and 2,2-bis(3-hydroxyphenyl)-1,1,1,3,3,3-hexafluoropropane; bis(4-hydroxyphenyl)ethers such as bis(3-fluoro-4-hydroxyphenyl)ether; alkylene oxide (ethylene oxide, propylene oxide, butylene oxide) adducts of the above alicyclic diol; and alkylene oxide (ethylene oxide, propylene oxide, butylene oxide) adducts of the above bisphenols. Among them, preferable are alkylene glycol having 2 to 12 carbon atoms and alkylene oxide adducts of bisphenols. Particularly preferable is the combination of alkylene oxide adducts of bisphenols and alkylene glycol having 2 to 12 carbon atoms.

Additionally, trivalent or more polyol (1) includes trivalent or more polyvalent aliphatic alcohol (glycerine, trimethylol ethane, trimethylol propane, pentaerythritol and sorbitol); trivalent phenols (tris phenol PA, phenol novolak and cresol novolak) and alkylene oxide adducts of the above trivalent or more polyphenols.

The above polyol can be used alone or in combination of two or more, and is not limited to the above.

Polycarboxylic acids (2) include alkylene dicarboxylic acids (succinic acid, adipic acid, sebacic acid); alkenyl dicarboxylic acids (maleic acid, fumaric acid); aromatic dicarboxylic acids (phthalic acid, isophthalic acid, terephthalic acid, naphthalene dicarboxylic acids, 3 fluoroisophthalic acid, 2-fluoroisophthalic acid, 2-fluoroterephthalic acid, 2,4,5,6-tetrafluoroisophthalic acid, 2,4,5,6-tetrafluoroterephthalic acid, 2,2-bis(4-carboxyphenyl)hexafluoropropane, 2,2-bis(4-carboxyphenyl)hexafluoropropane, 2,2-bis(3-carboxyphenyl)hexafluoropropane, 2,2-bis(trifluoromethyl)-4,4-biphenyl dicarboxylic acid, 3,3'-bis(trifluoromethyl)-4,4'-biphenyl dicarboxylic acid, 2,2'-bis(trifluoromethyl)-3,3'-biphenyl dicarboxylic acid, and hexafluoroisoproylidene diphthalic acid anhydrate. Among them, preferable are alkenylene dicarboxylic acids having 4 to 20 carbon atoms and aromatic dicarboxylic acids having 8 to 20 carbon atoms.

Additionally, trivalent or more polycarboxylic acids include aromatic polycarboxylic acid (trimellitic acid, pyromellitic acid) having 9 to 20 carbon atoms and anhydrates and lower alkyl ester (methyl ester, ethyl ester, isopropyl ester) of the above aromatic polycarboxylic acids.

The above polycarboxylic acids can be used alone or in combination of two or more, and are not limited to the above.

Upon synthesis of the polyester resin, for a ratio of polyol (1) to polycarboxylic acid (2), an equivalent ratio [OH]/{COOH] of hydroxyl group [OH] to carboxylic group [COOH] is typically 2/1 to 1/1, preferably 1.5/1 to 1/1 and more preferably 1.3/1 to 1.02/1.

A peak molecular weight of the polyester resin is typically 1,000 to 30,000 and preferably 1,500 to 10,000 and more preferably 2,000 to 8,000. When the peak molecular weight is less than 1,000, the heat resistant storage stability is sometimes reduced. When it exceeds 10,000, the fixing property at low temperature is sometimes reduced.

In the present invention, it is preferable that the binding resin (A) contains the polyester resin having the glass transition temperature of 40° C. or above and 80° C. or below. When the glass transition temperature is lower than 40° C., the heat resistant storage stability is sometimes reduced. When it exceeds 80° C., the fixing property at low temperature is sometimes reduced.

In the present invention, for controlling a viscoelasticity for the purpose of offset prevention, the binding resin (A) preferably contains a modified polyester resin, and more preferably contains the modified polyester resin having an urethane group and/or an urea group.

A content of the modified polyester resin in the binding resin (A) is preferably 20% by weight or less, more preferably 15% by weight or less and particularly preferably 10% by weight or less. When the content of the modified polyester resin exceeds 20% by weight, the fixing property at low temperature is sometimes reduced. The modified polyester resin may be directly mixed or may form the toner base particle. However, in terms of productivity, it is preferable to obtain the modified polyester resin by mixing the polyester resin (hereinafter referred to as a prepolymer (A)) having an isocyanate group at the end with amines which reacts with this, and performing an extending and/or crosslinking reaction during or after the granulation.

The prepolymer (A) can be obtained by further reacting the polyester resin which is the polycondensate of polyol (1) and polycarboxylic acid (2) and has an active hydrogen group with isocyanate (3). The active hydrogen group includes hydroxyl groups (alcoholic hydroxyl groups and phenolic hydroxyl groups), amino groups, carboxyl groups and mercapto groups, and the alcoholic hydroxyl groups are preferable.

Polyisocyanate (3) includes aliphatic polyisocyanate (tetramethylene diisocyanate, hexamethylene diisocyanate, 2,6-diisocyanatomethyl caproate); alicyclic polyisocyanate (isophorone diisocyanate, cyclohexylmethane diisocyanate); aromatic diisocyanate (tolylene diisocyanate, diphenylmethane diisocyanate); aromatic diisocyanate ($\alpha,\alpha,\alpha',\alpha'$-tetramethylxylylene diisocyanate), and isocyanurate. They may be blocked with a phenol derivative, oxime or caprolactam. These may be used in combination of two or more.

Upon synthesis of the prepolymer, for the ratio of polyisocyanate to the polyester resin having the active hydrogen group, the equivalent ratio [NCO]/[OH] of isocyanate group [NCO] to hydroxyl group [OH] of the polyester resin having the active hydrogen group is typically 5/1 to 1/1, preferably 4/1 to 1.2/1 and more preferably 2.5/1 to 1.5/1. When [NCO]/[OH] exceeds 5, the fixing property at low temperature is sometimes reduced. When it is less than 1, the content of the urethane group and/or the urea group in the modified polyester resin is reduced, and the offset resistance is sometimes reduced.

The content of a structural component derived from polyisocyanate (3) in the prepolymer (A) is typically 0.5% by weight to 40% by weight, preferably 1% by weight to 30% by weight and more preferably 2% by weight to 20% by weight. When this content is less than 0.6% by weight, the offset resistance is sometimes reduced. When it exceeds 40% by weight, the fixing property at low temperature is sometimes reduced.

A number of the isocyanate group per molecule of the prepolymer (A) is typically 1 or more, preferably 1.5 to 3 and more preferably 1.8 to 2.5. When the number of the isocyanate group is less than 1, the molecular weight of the modified polyester resin becomes low, and the offset resistance is sometimes reduced.

In the present invention, as an extending agent and/or a crosslinking agent, it is possible to use amines (B). Amines (B) include diamine (B1), trivalent or more polyamine (B2), amino alcohol (B3), aminomercaptan (B4) and B1 to B5 whose amino group has been blocked (B6).

Diamine (B1) includes aromatic diamine (phenylenediamine, diethyltoluenediamine, 4,4'-diaminodiphenylmethane, tetrafluoro-p-xylylenediamine, tetrafluoro-p-phenylenediamine); alicyclic diamine (4,4'-diamino-3,3'-dimethyldicyclohexylmethane, diaminocyclohexane, isophoronediamine); aliphatic diamine (ethylenediamine, tetramethylenediamine, hexamethylenediamine, dodecafluorohexylenediamine, tetracosafluorododecyldiamine).

Trivalent or more polyamine (B2) includes diethylenetriamine and triethylenetetramine.

Amino alcohol (B3) includes ethanolamine and hydroxyethylaniline.

Aminomercaptan (B4) includes aminoethylmercaptan and aminopropylmercaptan.

Amino acid (B5) includes aminopropionic acid and aminocaproic acid.

B1 to B5 whose amino group has been blocked (B6) include ketimine compounds and oxazoline compounds obtained from B1 to B5 and ketones (acetone, methyl ethyl ketone, methyl isobutyl ketone).

Furthermore, a terminator can be used if necessary for the extending reaction and/or the crosslinking reaction to control the molecular weight of the modified polyester resin. The terminator includes monoamine (diethylamine, dibutylamine, butylamine, laurylamine), and those (ketimine compounds) obtained by blocking them.

For the ratio of the prepolymer (A) to amines (B) upon synthesis of the modified polyester resin, the equivalent ratio [NCO]/[NHx] of the isocyanate group in the prepolymer (A) to the amino group [NHx] in amines is typically 1/2 to 2/1, preferably 1.5/1 to 1/1.5 and more preferably 1.2/1 to 1/1.2. When [NCO]/[NHx] is larger than 2 and less than ½, the molecular weight of the modified polyester resin becomes small, and the offset resistance is sometimes reduced.

In the present invention, as the colorant, publicly known dyes and pigments can be used. For example, carbon black, nigrosin dyes, iron black, naphthol yellow S, hanza yellow (10G, 5G, G), cadmium yellow, yellow iron oxide, yellow ocher, chrome yellow, titanium yellow, polyazo yellow, oil yellow, hanza yellow (GR, A, RN, R), pigment yellow L, benzidine yellow (G, GR), permanent yellow (NCG), Balkan fast yellow (5G, R), tartrazine lake, quinoline yellow lake, anthrazane yellow BGL, isoindolinone yellow, colcothar, red lead, lead vermillion, cadmium red, cadmium mercury red, antimony vermillion, permanent red 4R, parared, faicer red, parachloroorthonitroaniline red, lithol fast scarlet G, brilliant fast scarlet, brilliant carmine BS, permanent red (F2R, F4R, FRL, FRLL, F4RH), fast scarlet VD, Balkan fast rubine B, brilliant scarlet G, lithol rubine GX, permanent red F5R, brilliant carmine GB, pigment scarlet 3B, Bordeaux 5B, toluidine maroon, permanent Bordeaux F2K, helio Bordeaux BL, Bordeaux 10B, bon maroon light, bon maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, non-metallic phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, pyridian, emerald green, pigment green B, naphthol green B, green gold, acid green lake, malachite green, phthalocyanine green, anthraquinone green, titanium oxide, zinc flower, lithopone and mixtures thereof can be used. The content of the colorant in the toner is typically 1% by weight to 15% by weight and preferably 3% by weight to 10% by weight.

In the present invention, the colorant can also be used as a master batch obtained by making a complex with the resin. As the resin used for the production of the master batch or kneaded with the master batch, it is possible to use the same resins as in the binding resin (A).

The master batch can be obtained by mixing and kneading the resin and the colorant with a high shearing force. At that time, an organic solvent can be used in order to enhance an interaction of the colorant and the resin. The method, so-called flushing method in which an aqueous paste of the colorant is mixed and kneaded together with the resin and the organic solvent to migrate the colorant to a resin side and water and the organic solvent are removed is preferably used because a wet cake of the colorant can be directly used and drying is not required. To mix and knead, a high shearing dispersing apparatus such as three roll mill is preferably used.

It is preferable that the toner of the present invention further contains a releasing agent. As the releasing agent, those known publicly can be used. For example, polyolefin waxes (polyethylene wax, polypropylene wax); long chain hydrocarbon (paraffin wax, Southall wax); and carbonyl group containing waxes are included. The carbonyl containing waxes include polyalkanoate ester (carnauba wax, montan wax, trimethylolpropane tribehenate, pentaerythritol tetrabehenate, pentaerythritol diacetate dibehenate, glycerine tribehenate, 1,18-octadecanediol distearate); polyalkanol ester (trimellitate tristearyl, maleate distearyl); polyalkanoate amide (ethylenediamine dibehenylamide); polyalkyl amide (trimellitate tristearyl amide); and dialkyl ketone(distearyl ketone). Among carbonyl group containing waxes, polyalkanoate ester is preferable.

In the present invention, the content of the releasing agent in the toner is preferably 5% by weight to 15% by weight. When the content of the releasing agent is less than 5% by weight, flexibility for prevention of the offset is sometimes lost. When it exceeds 15% by weight, the releasing agent is melted at low temperature. Thus, the toner is easily affected by heat energy and mechanical energy, the releasing agent steeps from an inside of the toner upon stirring in the developing section and adheres to a toner regulatory member and the photoconductor to cause image noises.

A melting point of the releasing agent measured by a differential scanning calorimeter (DSC) is preferably 65° C. to 115° C. When the melting point is lower than 65° C., the fluidity is sometimes reduced. When it is higher than 115° C., the fixing property at low temperature is sometimes reduced.

It is preferable that the toner of the present invention further contains a charge controlling agent. As the charge controlling agent, those known publicly can be used. For example, nigrosin dyes, triphenylmethane dyes, chromium-containing metal complex dyes, molybdic acid chelate pigments, rhodamine-based dyes, alkoxy-based amine, quaternary ammonium salts (including fluorine modified quaternary ammonium salts), alkylamide, a single body or compounds of phosphorus, a single body or compounds of tungsten, fluorine-based surfactants, salicylate metal salts and metal salts of salicylic acid derivatives are included. Specifically, Bontron 03 of the nigrosin dye, Bontron P-51 of the quaternary ammonium salt, Bontron S-34 of the metal-containing azo dye, E-82 of oxynaphthoic acid-based metal complex, E-84 of salicylic acid-based metal complexes, E-89 of phenol-based condensate (supplied from Orient Chemical Industries Ltd.); TP-302 and TP-415 of a quaternary ammonium salt molybdenum complexes (supplied from Hodogaya Chemical Co., Ltd.); Copy Charge PSY VP2038 of the quaternary ammonium salts, Copy Blue PR of the triphenylmethane derivative, Copy Charge NEG VP2036 and Copy Charge NX VP434 of the quaternary ammonium salts (supplied from Hoechst); LRA-901, LA-147 which is a boron complex (supplied from Japan Carlit Co., Ltd.) copper phthalocyanine, perylene, quinacridone, azo-based pigments, and polymer-based compounds having functional groups such as sulfonic acid group, carboxyl group and quaternary ammonium salt are included.

In the present invention, the externally adding agent for aiding the fluidity, the developing property and the charge property of the toner base particles contains at least the particle composed of silicon oxide, and inorganic particles other than this can be used. The inorganic particles include small diameter particles having an average primary particle diameter of 7 nm to 40 nm used as a plasticizer, medium diameter particles having the average primary particle diameter of 40 nm to 150 nm and a spacer effect which allows the particles to adhere to the toner sufficiently (capable of being immobilized), and large diameter particles having the average primary particle diameter of 200 nm or more (in particular, 0.25 nm to 2 nm) used as a charge aid and a cleaner aid. The small diameter particles and the medium diameter particles have the large effect on the burying. Thus, their average primary particle diameter is equal to or less than the thickness of a shell material layer, more preferably ⅔ or less of the thickness of the shell material layer and particularly preferably ½ or less of the thickness of the shell material layer. The large diameter particle easily adheres to or separates from the toner base particle, has the less effect on the burying, and thus is not particularly restricted.

The average primary particle diameter of the inorganic particles is preferably 5 nm to 2 μm and more preferably 5 nm to 500 nm. A specific surface area by BET method is preferably 20 $m^2/g$ to 500 $m^2/g$.

The content of the inorganic particles in the toner is preferably 0.01% by weight to 5% by weight and more preferably 0.01% by weight to 2.0% by weight. The inorganic particles other than silicon oxide include, for example, alumina, titanium oxide, barium titanate, magnesium titanate, calcium titanate, strontium titanate, zinc oxide, tin oxide, quartz sand, clay, mica, sand-lime stone, diatom earth, chromium oxide, cerium oxide, colcothar, antimony trioxide, magnesium oxide, zirconium oxide, barium sulfate, barium carbonate, calcium carbonate, silicon carbide, and silicon nitride.

The externally adding agent includes polymer particles, e.g., particles of polystyrene obtained by soap free emulsification polymerization, suspension polymerization or dispersion polymerization, copolymers of methacrylate ester and acrylate ester, polycondensation based resins of silicone resins, benzoguanamine and nylon, and thermosetting resins.

In such an externally adding agent, by giving the surface treatment to increase the hydrophobicity, it is possible to inhibit the reduction of the fluidity and the charge property under the high humidity environment. A surface treating agent includes silane coupling agents, silylation agents, silane coupling agents having alkyl fluoride group, organic titanate based coupling agents, aluminium based coupling agents, silicone oils and modified silicone oils.

In order to easily remove the toner left on the photoconductor and a primary transfer medium after the transfer, it is possible to add a cleaning ability enhancer as the externally adding agent. The cleaning ability enhancer includes fatty acid metal salts such as zinc stearate and calcium stearate, and polymer particles such as methyl polymethacrylate particles and polystyrene particles produced by soap free emulsification polymerization. It is preferable that the polymer particles have a relatively narrow particle size distribution and the volume average particle diameter of 0.01 μm to 1 μm.

In the present invention, it is preferable that the resin having the functional group represented by the chemical structural formula (1) uniformly covers the surface of the toner base particles. For example, by controlling a polarity and the molecular weight of the resin in the range in which the compatibility is not inhibited, it is possible to orient to the surface, and by aggregating and/or fusion-bonding the particles, it is possible to form the shell material. As a result, the surface property and the charge amount distribution of the toner particles become uniform. Thus, it is possible to enhance or stabilize a mobility of the toner.

In the present invention, it is preferable that the resin having the functional group represented by the chemical structural formula (1) is a vinyl based copolymer resin. The vinyl based copolymer resin is not particularly limited as long as it has the functional group represented by the chemical structural formula (1), any one can be used and several types of the vinyl based copolymer resins may be mixed and used. A weight average molecular weight is preferably 50,000 or less, and more preferably 30,000 or less. When the weight average molecular weight is larger than 50,000, the fixing property at low temperature is sometimes reduced. The glass transition temperature is preferably 40° C. to 80° C. and more preferably 50° C. to 70° C. When the glass transition temperature is higher than 80° C., the fixing property at low temperature is sometimes reduced. When it is lower than 40° C., the heat resistant storage stability is sometimes reduced.

The vinyl based copolymer resin is obtained by copolymerizing a vinyl based monomer. The vinyl based monomers not having the functional group represented by the chemical structural formula (1) include the following (1) to (10).

(1) Vinyl Based Hydrocarbon

Aliphatic vinyl based hydrocarbon includes alkenes (ethylene, propylene, butene, isobutene, pentene, heptene, diisobutylene, octene, dodecene, octadecene, α olefin other than these); and alkadienes (butadiene, isoprene, 1,4-pentadiene, 1,6-hexadiene, 1,7-octadiene).

Alicyclic vinyl based hydrocarbon includes mono or dicycloalkene and alkadienes (cyclohexene, (di)cyclopentadiene, vinyl cyclohexene, ethylidene bicycloheptene); and terpenes (pinene, limonene, indene).

Aromatic vinyl based hydrocarbon includes styrene and hydrocarbyl (alkyl, cycloalkyl, aralkyl and/or alkenyl) substituents thereof (α-methylstyrene, vinyl toluene, 2,4-dimethylstyrene, ethylstyrene, isopropylstyrene, butylstyrene, phenyl styrene, cyclohexylstyrene, benzylstyrene, chlotilbenzene, divinyl benzene, divinyl toluene, divinyl xylene, trivinyl benzene), vinyl naphthalene.

(2) Carboxyl group containing vinyl based monomer and salts thereof. Carboxyl group containing vinyl based monomers and salts thereof include unsaturated monocarboxylic acids, unsaturated dicarboxylic acids having 3 to 30 carbon atoms and anhydrates thereof and monoalkyl (1 to 24 carbon atoms) esters thereof ((meth)acrylic acid, maleic acid, monoalkyl maleate, fumaric acid, monoalkyl fumarate, crotonic acid, itaconic acid, monoalkyl itaconate, itaconic acid glycol monoether, citraconic acid, monoalkyl citraconate, cinnamic acid).

(3) Sulfonic acid containing vinyl based monomers, vinyl based sulfate monoesters and salts thereof. Sulfonic acid containing vinyl based monomers include alkene sulfonate having 2 to 14 carbon atoms (vinyl sulfonate, (meth)allyl sulfonate, methylvinyl sulfonate, styrene sulfonate) alkyl derivatives having 2 to 24 carbon atoms (α-methylstyrene sulfonate); sulfo(hydroxy)alkyl(meth)acrylate or (meth) acrylamide(sulfopropyl(meth)acrylate, 2-hydroxy-3-(meth) acryloxypropyl sulfonate, 2-(meth)acryloylamino-2,2-dimethylethane sulfonate, 2-(meth)acryloyloxyethene sulfonate, 3-(meth)acryloyloxy-2-hydroxypropane sulfonate, 2-(meth) acrylamide-2-methylpropane sulfonate, 3-(meth)acrylamide-2-hydroxypropane sulfonate and alkyl (3 to 18 carbon atoms) allylsulfosuccinic acid).

Vinyl based sulfate monoesters include sulfate esters of polyoxyalkylene (ethylene, propylene, butylene) (n=2 to 30, may be alone, random or block)mono(meth)acrylate (sulfate ester of polyoxypropylene (n=5 to 15) monomethacrylate).

(4) Phosphate Group Containing Vinyl Based Monomers and Salts Thereof

Phosphate group containing vinyl based monomers include (meth)acryloyloxyalkyl phosphate monoesters (2-hydroxyethyl(meth)acryloyl phosphate, phenyl-2-acryloyloxyethyl phosphate); (meth) acryloyloxyalkyl (1 to 24 carbon atoms) phosphoric acids (2-acryloyloxyethyl phosphoric acid).

The salts of the above (2) to (4) include alkali metal salts (sodium salts, potassium salts), alkali earth metal salts (calcium salts, magnesium salts), ammonium salts, amine salts, and quaternary ammonium salts.

(5) Hydroxyl Group Containing Vinyl Based Monomers

Hydroxyl group containing vinyl based monomers include hydroxystyrene, N-methylol(meth)acrylamide, hydroxyethyl(meth)acrylate, hydroxypropyl(meth)acrylate, polyethylene glycol mono(meth)acrylate, (meth)allyl alcohol, chlotil alcohol, isochlotil alcohol, 1-butene-3-ol, 2-butene-3-ol, 2-butene-1,4-diol, propargyl alcohol, 2-hydroxyethylpropenyl ether, and sucrose allyl ether.

(6) Nitrogen Containing Vinyl Based Monomers

Amino group containing vinyl based monomers include aminoethyl(meth)acrylate, dimethylaminoethyl(meth)acrylate, diethylaminoethyl(meth)acrylate, t-butylaminoethyl (meth)acrylate, N-aminoethyl(meth)acrylamide, (meth)allylamine, morpholinoethyl (meth)acrylate, 4-vinyl pyridine, 2-vinyl pyridine, chlotilamine, N,N-dimethylaminostyrene, methyl-α-acetoamino acrylate, vinyl imidazole, N-vinyl pyrrol, N-vinyl thiopyrrolidone, N-aryl phenylenediamine, amino carbazole, amino thiazole, amino indole, amino pyrrol, amino imidazole, amino mercaptothiazole and salts thereof.

Amide group containing vinyl monomers include (meth) acrylamide, N-methyl(meth)acrylamide, diacetone acrylamide, N-methylol(meth)acrylamide, N,N-methylene-bis (meth)acrylamide, cinnamic acid amide, N,N-dimethylacrylamide, N,N-dibenzylacrylamide, methacryl formamide, N-methyl-N-vinyl acetamide, and N-vinyl pyrrolidone.

Nitrile group containing vinyl based monomers include (meth)acrylonitrile, cyanostyrene and cyano acrylate.

Quaternary ammonium salt containing vinyl based monomers include quaternized compounds (quaternized using a quaternizing agent such as methyl chloride, dimethyl sulfate, benzyl chloride and dimethyl carbonate) of tertiary amine group containing vinyl based monomers such as dimethylaminoethyl (meth)acrylate, diethylaminoethyl (meth)acrylate, dimethylaminoethyl (meth)acrylamide, diethylaminoethyl(meth)acrylamide and diallylamine.

Nitro group containing vinyl based monomers include nitrostyrene.

(7) Epoxy Group Containing Vinyl Based Monomers

Epoxy group containing vinyl based monomers include glycidyl (meth)acrylate, tetrahydrofrufryl (meth)acrylate, and p-vinylphenylphenyl oxide.

(8) Vinyl ester, vinyl (thio) ether, vinyl ketone, vinyl sulfone and vinyl ester include vinyl acetate, vinyl propionate, vinyl butyrate, diallyl phthalate, diallyl adipate, isopropenyl acetate, vinyl methacrylate, methyl-4-vinyl benzoate, cyclohexyl methacrylate, benzyl methacrylate, phenyl(meth)acrylate, vinyl methoxy acetate, vinyl benzoate, ethyl-α-ethoxy acrylate, alkyl (having alkyl group having 1 to 50 carbon atoms) (meth)acrylate methyl (meth)acrylate, ethyl(meth) acrylate, propyl(meth)acrylate, butyl(meth)acrylate, 2-ethylhexyl (meth)acrylate, dodecyl(meth)acrylate, hexadecyl (meth)acrylate, heptadecyl(meth)acrylate, eicosyl(meth) acrylate; dialkyl fumarate (two alkyl groups are straight, branched or alicyclic alkyl groups having 2 to 8 carbon atoms); dialkyl maleate (two alkyl groups are straight, branched or alicyclic alkyl groups having 2 to 8 carbon atoms); poly(meth)allyloxy alkanes(diallyloxyethane, triallyloxyethane, tetraallyloxyethane, tertaallyloxypropane, tertaallyloxybutane, tetraallyloxyethane); vinyl based monomers having polyalkylene glycol (polyethylene glycol (molecular weight 300) mono(meth)acrylate, polypropylene glycol (molecular weight 500) monoacrylate, (meth)acrylate ester of methyl alcohol ethylene oxide 10 mol adduct, (meth) acrylate ester of lauryl alcohol ethylene oxide 30 mol adduct); (meth)acrylate ester of polyvalent alcohol (ethylene glycol di(meth)acrylate, propylene glycol di(meth)acrylate, neopentyl glycol di(meth)acrylate, trimethylolpropane tri(meth) acrylate, polyethylene glycol di(meth)acrylate,).

Vinyl (thio)ether includes vinyl methyl ether, vinyl ethyl ether, vinyl propyl ether, vinyl butyl ether, 2-ethylhexyl vinyl ether, vinyl phenyl ether, 2-methoxyethyl vinyl ether, methoxybutadiene, 2 butoxyethyl vinyl ether, 3,4-dihydro-1,2-pyrane, 2-butoxy-2'-vinyloxydiethyl ether, 2-ethylmercaptoethyl vinyl ether, acetoxystyrene and phenoxystyrene.

Vinyl ketone includes vinyl methyl ketone, vinyl ethyl ketone and vinyl phenyl ketone.

Vinyl sulfone includes divinyl sulfide, p-vinyl diphenyl sulfide, vinyl ethyl sulfide, vinyl ethyl sulfone, divinyl sulfone and divinyl sulfoxide.

(9) Other Vinyl Based Monomers

Other vinyl monomers include isocyanate ethyl (meth) acrylate, m-isopropenyl-α,α-dimethylbenzyl isocyanate.

(10) Fluorine Atom Containing Vinyl Based Monomers

Fluorine atom containing vinyl based monomers include 4-fluorostyrene, 2,3,5,6-tetrafluorostyrene, pentafluorophenyl (meth)acrylate, pentafluorobenzyl(meth)acrylate, pentafluorohexyl(meth)acrylate, perfluorocyclohexycylmethyl (meth)acrylate, 2,2,2-trifluoroethyl (meth)acrylate, 2,2,3,3-tetrafluoropropyl (meth)acrylate, 1H,1H,4H-hexafluorobutyl (meth)acrylate, 1H,1H,5H-octafluoropentyl (meth)acrylate, 1H,1H,7H-dodecafluoroheptyl(meth)acrylate, perfluorooctyl(meth)acrylate, 2-perfluorooctylethyl(meth)acrylate, heptadecafluorodecyl(meth)acrylate, torihydroperfluoroundecyl (meth)acrylate, perfluoronorbornylmethyl(meth)acrylate, perfluoroisobornyl(meth)acrylate, 2-(N-butylperfluorooctane sulfone amide)ethyl(meth)acrylate, 2-(N-ethylfluorooctanesulofoneamide)ethyl (meth)acrylate, corresponding compounds thereto derived from α-fluoroacrylic acids, bis (hexafluoroisopropyl)itaconate, bis(hexafluoroisopropyl) maleate, bis(perfluorooctyl)itaconate, bis(perfluorooctylmaleate, bis(trifluoroethyl)itaconate, bis(trifluoroethyl) maleate, vinyl heptafluoro butyrate, vinyl heptafluoro nanoate and vinyl perfluorooctanoate.

Vinyl monomers having at least silanol group include, but are not particularly limited to, vinyl trimethoxysilane, vinyl triethoxysilane, vinyl triacetoxysilane, p-styryl trimethoxysilane, 3-methacryloyloxypropylmethyl dimethoxysilane, 3-methacryloyloxypropylmethyl trimethoxysilane, 3-methacryloyloxypropylmethyl diethoxysilane, 3-methacryloyloxypropyl triethoxysilane, 3-acryloyloxypropyl trimethoxysilane, 3-methacryloyloxypropylmethyl propoxysilane, 3-methacryloyloxypropylmethyl diisopropoxysilane, 3-methacryloyloxypropyldimethyl cyclohexyloxysilane, p-styryl dimethylphenoxysilane, and p-styryl tribenzyloxysilane.

It is preferable to use the particles containing the vinyl based copolymer resin having at least the silanol group in a state in which they are dispersed in the water-based medium. Such particles containing the vinyl based copolymer resin can be generally produced by the general emulsification polymerization.

The method for producing the toner of the present invention is not particularly limited, and the toner is suitably produced by the following production method.

It is preferable that the method for producing the toner of the present invention has at least a step of dispersing a dispersion in which a toner composition containing at least the polyester resin and the colorant has been dissolved or dispersed in an organic solvent in the water-based medium to granulate the core material, and a step of adding a water-based dispersion in which particles containing the resin having at least the functional group represented by the chemical structural formula (1) have been dispersed in a water-based medium to adhere the particles to the core material. Specifically, the method is as follows.

It is preferable that the organic solvent in which the toner composition is dissolved or dispersed has a boiling point of lower than 100° C. and volatile because it makes the subsequent removal thereof easy. Such an organic solvent includes, for example, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These can be used alone or in combination of two or more. In particular, ester based solvents such as methyl acetate and ethyl acetate, aromatic solvents such as toluene and xylene, and halogenated hydrocarbon such as methylene chloride, 1,2-dichloroethane, chloroform and carbon tetrachloride are preferable. Contents in the toner composition may be simultaneously dissolved or dispersed, but may be separately dissolved and dispersed and at that time, the solvents used may be different. However, considering the subsequent treatment of the solvents, it is preferable that the solvents used are the same.

A resin concentration in the solution or the dispersion of the toner composition is preferably 40% by weight to 80% by weight. When the resin concentration exceeds 80% by weight, the dissolution or the dispersion becomes difficult and the viscosity becomes high, which is hardly handled. When it is less than 40% by weight, the amount of the toner to be produced becomes small. When the polyester resin and the prepolymer are mixed, they may be mixed in the same solution or dispersion, or the solution or the dispersion may be prepared separately, but considering each solubility and viscosity, it is preferable to prepare the solution or the dispersion separately.

The colorant alone may be dissolved or dispersed, or may be mixed in the solution or the dispersion of the polyester resin. If necessary, a dispersion aid or the polyester resin may be added, or the master batch may be used.

When wax is dissolved or dispersed as the releasing agent, if the organic solvent which does not dissolve the wax, the wax is used as the dispersion, and the dispersion is made by general methods. That is, the organic solvent and the wax could be mixed and dispersed using a dispersing machine such as bead mill. When the organic solvent and the wax are mixed, then the mixture is heated up to a melting point of the wax, subsequently cooled with stirring and then dispersed by the dispersing machine such as bead mill, a dispersion time period is sometimes shortened. Multiple types of waxes may be mixed and used, and the dispersion aid or the polyester resin may be added.

The water-based medium may be water alone, and the solvent miscible with the water can be combined. The miscible solvents include alcohol (methanol, isopropanol, ethylene glycol), dimethylformamide, tetrahydrofuran, cellsolves (methyl cellsolve) and lower ketones (acetone, methyl ethyl ketone). The amount of the water-based medium to be used is typically 50 parts by weight to 2,000 parts by weight, and preferably 100 parts by weight to 1,000 parts by weight relative to 100 parts by weight of the toner composition. When the amount of the water-based medium to be used is less than 50 parts by weight, a dispersion state of the toner composition becomes sometimes poor. When it exceeds 2,000 parts by weight, it is not economical.

When the solution or the dispersion of the toner composition is dispersed in the water-based medium, it is preferable to previously disperse an inorganic dispersant or resin particles. This makes the particle size distribution narrow and can disperse stably.

As the inorganic dispersant, tricalcium phosphate, calcium carbonate, titanium oxide, colloidal silica and hydroxyapatite are used.

Any resin can be used as the resin forming the resin particles as long as the resin can form an aqueous dispersion, and may be thermoplastic or thermosetting. For example, vinyl based resins, polyurethane resins, epoxy resins, polyester resins, polyamide resins, polyimide resins, silicon based resins, phenol resins, melamine resins, urea resins, aniline resins, ionomer resins and polycarbonate resins are included. These resins may be used in combination of two or more. Among them, the vinyl based resin, the polyurethane resin, the epoxy resin, polyester resin and combinations thereof are preferable because the aqueous dispersion of fine spherical resin particles is easily obtained.

The method for producing the aqueous dispersion of the resin particles is not particularly limited and includes the following (a) to (h).

(a) In the case of the vinyl based resin, the aqueous dispersion of the resin particles is directly produced using the monomer as a starting material by polymerization method such as suspension polymerization, emulsification polymerization or dispersion polymerization.

(b) In the polyaddition or condensation based resin such as polyester resin, polyurethane resin or epoxy resin, the aqueous dispersion of the resin particles is produced by dispersing a precursor (monomer, oligomer) or a solution thereof in the water-based medium in the presence of an appropriate dispersant and subsequently heating or adding a curing agent to cure.

(c) In the polyaddition or condensation based resin such as polyester resin, polyurethane resin or epoxy resin, an appropriate emulsifier is dissolved in the precursor (monomer, oligomer) or the solution thereof (it is preferable to be a liquid, may be liquefied by heating), and subsequently water is added to emulsify with phase inversion.

(d) The resin previously produced by polymerization reaction (may be any of addition polymerization, ring opening polymerization, polyaddition, addition condensation or polycondensation) is pulverized using a mechanically rotary or jet fine pulverizer and classified to yield the resin particles, which are then dispersed in water in the presence of the appropriate dispersant.

(e) The solution of the resin previously produced by polymerization reaction (may be any of addition polymerization, ring opening polymerization, polyaddition, addition condensation or polycondensation) is atomized by spraying to yield the resin particles, which are then dispersed in water in the presence of the appropriate dispersant.

(f) The resin particles are precipitated by adding the solvent to a resin solution in which the resin previously produced by polymerization reaction (may be any of addition polymerization, ring opening polymerization, polyaddition, addition condensation or polycondensation) has been dissolved or cooling the resin solution which has been heated and dissolved previously in the solvent, and the solvent is removed to yield the resin particles, which are then dispersed in the water-based medium in the presence of the appropriate dispersant.

(g) The solution of the resin previously produced by polymerization reaction (may be any of addition polymerization, ring opening polymerization, polyaddition, addition condensation or polycondensation) is dispersed in the water-based medium in the presence of the appropriate dispersant, and subsequently the solvent is removed by heating or reducing pressure.

(h) The appropriate emulsifier is dissolved in the solution of the resin previously produced by polymerization reaction (may be any of addition polymerization, ring opening polymerization, polyaddition, addition condensation or polycondensation), and subsequently water is added to emulsify with phase inversion.

In order to emulsify or disperse the solution or the dispersion of the toner composition in the water-based medium, the surfactant can also be used if necessary. The surfactant includes anionic surfactants such as alkylbenzene sulfonate salts, α-olefin sulfonate salts and phosphate ester; cationic surfactants such as amine salts such as alkylamine salts, amino alcohol fatty acid derivatives, polyamine fatty acid derivatives and imidazoline, and quaternary ammonium salts such as alkyltrimethyl ammonium salts, alkyldimethyl ammonium salts, alkyldimethylbenzyl ammonium salts, pyridinium salts, alkylisoquinolinium salts and benzethonium chloride; nonionic surfactants such as fatty acid amide derivatives and polyvalent alcohol derivatives; and ampholytic surfactants such as alanine, dodecyl-bis(aminoethyl)glycine and N-alkyl-N,N-dimethyl ammonium betaine.

By using the surfactant having a fluoroalkyl group, it is possible to enhance the effect in an extremely small amount. The anionic surfactant having the fluoroalkyl group includes fluoroalkyl carboxylic acids having 2 to 10 carbon atoms and metal salts thereof, disodium perfluorooctanesulfonyl glutamate, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propanesulfonate, fluoroalkyl (C11 to C20) carboxylic acids and metal salts thereof, perfluoroalkyl (C7 to C13) carboxylic acids and metal salts thereof, perfluoroalkyl (C4 to C12) sulfonic acids and metal salts thereof, perfluorooctane sulfonate diethanol amide, N-propyl-N-(2-hydroxyethyl)perfluorooctane sulfone amide, perfluoroalkyl (C6 to C10) sulfone amide propyltrimethyl ammonium salts, perfluoroalkyl (C6 to C10)-N-ethylsulfonyl glycine salts and monoperfluoroalkyl (C6 to C10) ethyl phosphate salts. The cationic surfactant includes aliphatic primary, secondary or tertiary amine acids having the fluoroalkyl group, aliphatic quaternary ammonium salts such as perfluoroalkyl (C6 to C10) sulfone amide propyltrimethyl ammonium salts, benzalkonium salts, benzethonium chloride, pyridinium salts and imidazolinium salts.

Dispersed liquid drops may be stabilized by polymer based protection colloid. As the polymer based protection colloid, acids (acrylic acid, methacrylic acid, α-cyanoacrylic acid, α-cyanomethacrylic acid, itaconic acid, crotonic acid, fumaric acid, maleic acid or maleic acid anhydrate); (meth) acrylic monomers having hydroxyl group (β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerine monoacrylate, glycerine monomethacrylate, N-methylol acrylamide, N-methylol methacrylamide); vinyl alcohol or ether with vinyl alcohol (vinyl methyl ether, vinyl ethyl ether, vinyl propyl ether); esters of vinyl alcohol with a compound having carboxylic group (vinyl acetate, vinyl propionate, vinyl butyrate); acrylamide, methacrylamide, diacetone acrylamide or methylol compounds thereof; acid chloride (acrylic acid chloride, methacrylic acid chloride); homopolymers or copolymers of those having nitrogen atoms or heterocycle (vinyl pyridine, vinyl imidazole, ethyleneimine); polyoxyethylenes (polyoxyethylene, polyoxypropylene, polyoxyethylene alkylamine, polyoxypropylene alkylamine, polyoxyethylene alkylamide, polyoxypropylene alkylamide, polyoxyethylene nonylphenyl ether, polyoxyethylene laurylphenyl ether, polyoxyethylene stearylphenyl ether, polyoxyethylene nonylphenyl ester); celluloses (methylcellulose, hydroxyethylcellulose, hydroxypropylcellulose) and the like can be used.

When the compound such as calcium phosphate salt capable of being dissolved in acid or alkali is used as a dispersion stabilizer, the calcium phosphate salt can be removed from the core material by dissolving the calcium phosphate salt with the acid such as hydrochloric acid and subsequently washing with water. When the dispersant is used, the core material can be used with the dispersant left on its surface, but it is preferable to wash out the dispersant in terms of charge property of the toner.

The dispersion method is not particularly limited, and the publicly known methods such as low speed shearing, high speed shearing, friction, high pressure jet and ultrasonic modes can be applied. In order to make the average particle diameter of the dispersion 2 μm to 20 μm, the high speed shearing mode is preferable. When the high speed shearing mode dispersing machine is used, a rotary frequency is not particularly limited, and is typically 1,000 rpm to 30,000 rpm and preferably 6,000 rpm to 20,000 rpm. A dispersing time period is not particularly limited, and is typically 0.1 minutes to 5 minutes in the case of a batch mode. A temperature upon dispersion is typically 0° C. to 150° C. (under pressure) and preferably 20° C. to 80° C.

In order to remove the organic solvent from the resulting emulsified dispersion, it is possible to employ the method of raising the temperature of the entire system under atmospheric pressure or reduced pressure and evaporating and removing the organic solvent in the liquid drop. It is also possible to spray the emulsified dispersion into a dried atmosphere to remove the organic solvent in the liquid drop as well as remove the surfactant. As the atmosphere in which the emulsified dispersion is sprayed, heated gas such as air, nitrogen, carbon dioxide and combustion gas can be used, and various gas flows heated at the temperature equal to or higher than the boiling temperature of the organic solvent are generally used. At that time, a treatment time can be shortened by using a spray drier, a belt drier or a rotary kiln.

Subsequently, the step of adhering the particles containing the resin having the functional group represented by the chemical structural formula (1) to the surface of the core material will be described. In this step, it is preferable to use the water-based dispersion in which the particles containing the resin having the functional group represented by the chemical structural formula (1) have been dispersed. This dispersion can be produced by the ordinary emulsification polymerization, and may be directly used. For stabilizing the dispersion of the core material and the particles, for example the surfactant may be added. A timing when the particles are added may be before removing the organic solvent or after removing it.

In this step, in order to efficiently adhere the particles to the core material, pH may be adjusted with sodium hydroxide or hydrochloric acid. As a coagulant, a monovalent to trivalent metal salt may be added. The monovalent metal which composes the salt includes lithium, potassium and sodium. The bivalent metal includes calcium and magnesium. The trivalent metal includes aluminium. An anion which composes the salt includes chloride ion, bromide ion, iodide ion, carbonate ion and sulfate ion.

The adhesion of the particles may be accelerated by heating. But, when the particles are adhered at temperature around or equal to or lower than the glass transition temperature of the particle, the aggregation and/or the fusion bond of the particles one another scarcely progress. Thus, it is preferable to facilitate the aggregation and/or the fusion bond by further heating to facilitate the cover of the core material and make the surface of the core material even. At that time, a heating temperature and a heating time period are appropriately controlled in terms of evenness of the surface and shape of the toner base particles.

The amines (B) may be mixed as the organic solvent solution in the water-based medium before dispersing the toner composition, or may be added into the water-based medium. A time period required for the reaction synthesizing the modified polyester is appropriately selected depending on the reactivity of the prepolymer (A) with the amines (B), and is typically one minute to 40 hours and preferably one hour to 24 hours. A reaction temperature is typically 0 to 150° C. and preferably 20° C. to 98° C. This reaction may be performed before adhering the particles to the core material, or may be advanced simultaneously during this step, or may be performed after completing this step. If necessary, a publicly known catalyst can be used.

The publicly known methods are used for the step of washing and drying the toner base particles dispersed in the water-based medium. That is, the step of separating the solid from the liquid using a filter press after centrifugation, subsequently redispersing a resulting toner cake in ion exchange water at ambient temperature to about 40° C., adjusting its pH with acid or alkali as needed and separating the solid from the liquid is repeated. This gives the toner base particles by removing impurities and the surfactant, and then drying using a gas flow dryer, a circulation dryer, a dryer under reduced pressure or a vibration fluidal dryer. At that time, a fine particle component may be removed by centrifugation, or the desired particle diameter distribution can be obtained using a publicly known classifying machine as needed after drying.

A procedure to mix the externally adding agent with the toner base particles is not particularly limited, and a mixer such as Henschel mixer or super mixer can be used. Dissociation of the externally adding agent from the toner surface can be inhibited by giving a mechanical impact force to mixed powders to immobilize or fuse the externally adding agent to the surface of the toner base particles. Specifically, the method of adding the impact force to the mixture by rotating wings at high speed, or the method of adding the mixture in high speed gas flow, accelerating and allowing the particles one another or complexed particles to conflict to an appropriate conflict plate can be used. The apparatus includes Ang Mill (supplied from Hosokawa Micron Ltd.), an apparatus in which a pulverization air pressure has been reduced by remodeling I type mill (supplied from Nippon Pneumatic MFG. Co., Ltd.), a hybridization system (Nara Machinery Co., Ltd.), a cryptron system (supplied from Kawasaki Heavy Industries, Ltd.) and an automatic mortar.

The analysis and the evaluation of the toner were performed as follows. In the followings, the evaluation was performed as the one-component developer, but the toner of the present invention can be used as the two-component developer by using the suitable externally adding agent and the suitable carrier.

Subsequently, the method for measuring the particle size distribution of the toner will be described. The apparatus for measuring the particle size distribution of the toner by Coulter Counter method includes Coulter Counter TA-II and Coulter Multisizer II (both are supplied from Coulter). The measurement method is set forth below. First, 0.1 mL to 5 mL of the surfactant (preferably alkylbenzene sulfonate salt) as the dispersant is added to 100 mL to 150 mL of an aqueous solution of an electrolyte The aqueous solution of the electrolyte is the aqueous solution of about 1% by weight NaCl prepared using first grade sodium chloride, and for example, ISOTON-II (supplied from Coulter) can be used. Here, 2 mg to 20 mg of a sample to be measured in terms of solid is further added. The aqueous solution of the electrolyte in which the sample has been dispersed is treated for one minute to 3 minutes using an ultrasonic dispersing machine, and the volume and the number of the toner are measured by the measurement apparatus using 100 μm aperture to calculate the volume distribution and the number distribution. The volume average particle diameter (Dv) and the number average particle diameter (Dp) can be calculated from the resulting distributions.

As channels, 13 channels of 2.00 μm or more and less than 2.52 μm, 2.52 μm or more and less than 3.17 μm, 3.17 μm or more and less than 4.00 μm, 4.00 μm or more and less than 5.04 μm, 5.04 μm or more and less than 6.35 μm, 6.35 μm or more and less than 8.00 μm, 8.00 μm or more and less than 10.08 μm, 10.08 μm or more and less than 12.70 μm, 12.70 μm or more and less than 16.00 μm, 16.00 μm or more and less than 20.20 μm, 20.20 μm or more and less than 25.40 μm, 25.40 μm or more and less than 32.00 μm and 32.00 μm or more and less than 40.30 μm are used, and the particles having the particle diameter of 2.00 μm or more and less than 40.30 μm can be subjected.

As the method for measuring the shape of the toner, a technique of an optical detection zone by passing a suspension containing the toner through a taking a picture detecting zone, detecting an particle image optically by CCD camera and analyzing is appropriate. A value obtained by this technique by dividing a circumference length of a circle which has an area equal to a projected area by a circumference length of the actual particle is the average circularity. The average circularity can be measured by a flow type particle image analyzer FPIA-2000. As the specific method, 0.1 mL to 5 mL of the surfactant, preferably alkylbenzene sulfonate salt as the dispersant is added to 100 mL to 150 mL of water from which impurity solids have been previously removed in a vessel, and 0.1 g to 0.5 g of a sample to be measured is added thereto. The dispersion treatment for one minute to 3 minutes is given to the suspension of the sample using the ultrasonic dispersing machine, and the measurement is performed at a dispersion concentration of 3,000 to 10,000 particles/μL.

The molecular weight of the polyester resin and the vinyl based copolymer resin can be measured by usual GPC (gel permeation chromatography) under the following condition.

Apparatus: HLC-8220 GPC (supplied from Tosoh Corporation)
Temperature: 40° C.
Solvent: THF (tetrahydrofuran)
Flow rate: 1.0 mL/minute
Sample concentration: 0.05% by weight to 0.6% by weight
Amount of sample to be injected: 0.01 mL The number average molecular weight and the weight average molecular weight can be calculated from the molecular weight distribution of the resin measured under the above condition using a molecular weight calibration curve made from monodispersion polystyrene standard samples. As the monodispersion polystyrene standard samples, 10 points from $5.8\times10^2$ to $5\times10^6$ are used.

The glass transition temperature of the polyester resin and the vinyl based copolymer resin can be obtained using a differential scanning calorimeter DSC-622R (supplied from Seiko Instruments, Inc.) by first heating from room temperature to 150° C. at rising speed of 10° C./minute, leaving stand at 150° C. for 10 minutes, cooling the sample to room temperature and leaving stand for 10 minutes and heating again to 150° C. at rising speed of 10° C./minute. The glass transition temperature can be obtained from a baseline equal to or lower than the glass transition temperature and a curve portion where a height of a baseline equal to or higher than the glass transition temperature corresponds to ½.

The particle diameter of the resin particles is obtained by directly measuring the dispersion using the measurement apparatus such as LA-920 (supplied from Horiba) or UPA-EX150 (supplied from Nikkiso Co., Ltd.).

The method for measuring the film thickness of the shell material is described. The toner is embedded in the epoxy resin and cut into ultrathin slices of about 100 nm, which are then stained with ruthenium tetraoxide, observed under a transmission electron microscope (TEM) at magnifications of 5,000 times and 20,000 times, and photographed. Ten samples equivalent to the samples for the volume average particle diameter of the toner are selected and their images are evaluated. Three points of the film thickness of the shell material per sample are obtained, and 10 samples are averaged.

The process cartridge of the present invention supports integrally at least the photoconductor and the developing unit which develops the latent electrostatic image formed on the photoconductor using the toner of the present invention, and may further support integrally the units such as charging unit, transferring unit, cleaning unit and electricity removing unit appropriately selected as needed. The developing unit has at least a developer bearing member which bears and feeds the toner, and may have a layer thickness regulatory member for regulating the layer thickness of the toner borne.

The process cartridge of the present invention can be comprised detachably to the main body of the image forming apparatuses such as various electrographic apparatuses, facsimiles and printers, and it is preferable to be comprised detachably to the image forming apparatus of the present invention described later.

In FIG. 1, one example of the process cartridge of the present invention is shown. The process cartridge builds-in the photoconductor 201, has the charging unit 202, the developing unit 204, the transferring unit 208 and the cleaning unit 207, and if necessary further has the other unit. In FIG. 1, 203 and 205 indicate the exposure by the exposing unit and the recording medium, respectively.

As the photoconductor 201, the same one as in the image forming apparatus described later can be used, and an optional charging member is used for the charging unit 202.

Subsequently, a process of the image formation by the process cartridge show in FIG. 1 is described. As the photoconductor 202 is rotated in an arrow direction, the latent electrostatic image corresponding to an exposure image is formed on its surface by giving the charge by the charging unit 202 and the exposure by the exposing unit (not shown in the figure) to the photoconductor. This latent electrostatic image is developed in the developing unit 204, and a toner image is transferred by the transferring unit 208 onto the recording medium 205, and then printed out. Subsequently, the surface of the photoconductor 201 after the transfer is cleaned by the cleaning unit 207, and the electricity is removed by the electricity removing unit (not shown in the figure). The above manipulation is repeated.

The image forming apparatus of the present invention forms the image using the toner of the present invention. The toner of the present invention can be used for any of the one-component developer or the two-component developer, but it is preferable to use as the one-component developer. It is also preferable that the image forming apparatus of the present invention has an endless type intermediate transferring unit. Furthermore, the image forming apparatus of the present invention preferably has the cleaning unit which cleans the photoconductor and the toner left on the photoconductor and the/or the intermediate transferring unit. At that time, the cleaning unit may have a cleaning blade or not have the cleaning blade. It is also preferable that the image forming apparatus of the present invention has the fixing unit which fixes the image using a roller having a heating apparatus or a belt having the heating apparatus. Furthermore, it is preferable that the image forming apparatus of the present invention has the fixing unit which requires no oil application onto a fixing member.

The image forming apparatus of the present invention may integrally combine the components such as photoconductor, developing unit and cleaning unit as the process cartridge, and may combine the process cartridge detachably. Also, the process cartridge is formed by integrally supporting at least one of the charging unit, the exposing unit, the developing unit, the transferring unit, the separation unit and the cleaning unit with the photoconductor to make a single unit detachable to the image forming apparatus main body, and may be combined detachably using a guiding unit such as rails in the image forming apparatus main body.

The image forming apparatus of the present invention has at least the photoconductor, the latent electrostatic image forming unit, the developing unit, the transferring unit and the fixing unit, and preferably further if necessary has the other units, e.g., the electricity removing unit, the cleaning unit, the recycling unit and the controlling unit.

For the photoconductor, its material, shape, structure and size are not particularly limited, and can be appropriately selected from those known publicly. Its shape suitably includes a drum shape and a belt shape. Its material includes, for example, inorganic photoconductors such as amorphous silicon and serene, and organic photoconductors such as polysilane and phthalopolymethine. Among them, amorphous silicon is preferable in terms of long lifetime.

As an amorphous silicon photoconductor, it is possible to use the photoconductor obtained by heating the support at 50° C. to 400° C. and forming a light conductive layer composed of amorphous silicon on the support using a film forming method such as a vacuum deposit method, a spattering method, an ion plating method, a heat CVD method, an optical CVD method and a plasma CVD method. Among them, the plasma CVD method, i.e., the method in which a raw material gas is decomposed by direct current or high frequency or a microwave glow discharge to form an amorphous silicon deposit film on the support is suitable.

The formation of the latent electrostatic image on the photoconductor can be performed by charging the surface of the photoconductor and subsequently exposing like the image, and can be performed by the latent electrostatic image forming unit. The latent electrostatic image forming unit comprises at least the charging unit which charges the surface of the photoconductor and the exposing unit which exposes the surface of the photoconductor like the image.

Electrical charge can be performed, for example, by applying the voltage onto the surface of the photoconductor using the charging unit.

The charging unit is not particularly limited, can be appropriately selected depending on the purpose, and includes contact charging devices known publicly and comprising conductive or semi-conductive rollers, brushes, films or rubber blades and non-contact charging devices utilizing corona discharge such as corotron and scorotron.

The shape of the charging unit may be a magnetic brush or a fur brush in addition to the roller, and can be selected in conformity to a specification and a form of an electrographic apparatus. When the magnetic brush is used, the magnetic brush uses various ferrite particles such as Zn—Cu ferrite and is composed of non-magnetic conductive sleeve for supporting this and a magnet roll enclosed in this. When the brush is used, for example, as the material of the fur brush, the fur to which a conductive treatment with carbon, copper sulfide, metal or metal oxide is used, and this is looped or attached to the metal or a cored bar to which the conductive treatment has been given.

The charging unit is not limited to the above contact type, but it is preferable to use a contact type charging device because the image forming apparatus in which ozone produced from the charging device is reduced is obtained.

The exposure can be performed, for example, by using the exposing unit and exposing the surface of the photoconductor like the image. The exposing unit is not particularly limited as long as the exposure can be performed like the image to be formed on the surface of the photoconductor charged by the charging unit, appropriately selected depending on the purpose, and includes, for example, copy optical, rod lens array, laser optical and liquid crystal shutter exposing devices.

The development can be performed by using the toner of the present invention and developing the latent electrostatic image, and can be performed by the developing unit. The developing unit is not particularly limited as long as the development can be performed using the toner of the present invention, can be appropriately selected from those known publicly, and suitably includes those having at least the developing device which houses the toner of the present invention and can impart the toner to the latent electrostatic image in contact or in non-contact.

As the developing unit, an aspect having a developing roller which bears the toner on its surface, rotates in contact with the photoconductor as well as supplies the toner to the latent electrostatic image formed on the photoconductor to perform the development and a thin layer forming member which contacts with the surface of the developing roller and makes the toner on the developing roller thin is preferable.

The developing unit may be a dry developing system or a wet developing system, may be a developing device for multicolor, and suitably includes, for example, those having a stirring device which frictionizes and stirs the toner to charge and a rotatable magnet roller.

As the developing roller, either a metal roller or an elastic roller is suitably used. The metal roller is not particularly limited, can be appropriately selected depending on the purpose, and includes, for example, an aluminium roller. By giving a blast treatment to the metal roller, it is possible to relatively easily make the developing roller having an optional surface friction coefficient. Specifically, by treating the aluminium roller with glass bead blast, it is possible to make the roller surface rough and make the toner in an appropriate amount adhere onto the developing roller.

As the elastic roller, a roller covered with an elastic rubber layer is used, and a surface coating layer composed of the material which is easily charged to polarity opposed to the toner is provided on the surface. The elastic rubber layer is set to a hardness of 60 degree or less in JIS-A in order to prevent the toner deterioration due to pressure concentration at an abutting site against a layer regulatory member. A surface roughness (Ra) is set to 0.3 μm to 2.0 μm to retain the toner in a required amount on the surface. Since a development bias for forming an electric field between the developing roller and the photoconductor is applied to the developing roller, a resistance value of the elastic rubber layer is set to 103Ω to 1010Ω. The developing roller rotates in a clockwise direction and feeds the toner retained on its surface in a direction opposed to the layer regulatory member and the photoconductor.

The layer regulatory member is provided at a lower position than the abutting position of a supply roller and the developing roller. The layer regulatory member is obtained by using a plate spring material of the metal such as stainless (SUS) and phosphorus bronze and abutting its free end to the surface of the roller with a pushing pressure of 10 N/m to 40 N/m, makes the toner which has passed under the pushing pressure a thin layer and imparts the charge by friction charging. Furthermore, in order to aid the friction charging, a regulatory bias of a value obtained by offsetting in the same direction as the toner charge polarity for the development bias is applied to the layer regulatory member.

A rubber elastic body which composes the surface of the developing roller is not particularly limited, can be appropriately selected depending on the purpose, and includes, for example, styrene-butadiene based copolymer rubber, acrylonitrile-butadiene based copolymer rubber, acryl rubber, epichlorohydrin rubber, urethane rubber, silicone rubber or blends of two or more thereof. Among them, the blend rubber of epichlorohydrin rubber and acrylonitrile-butadiene based copolymer rubber is particularly preferable.

The developing roller is produced by, for example, covering the rubber elastic body outside a conductive shaft. The conductive shaft is composed of, for example the metal such as stainless (SUS).

Figure 2:
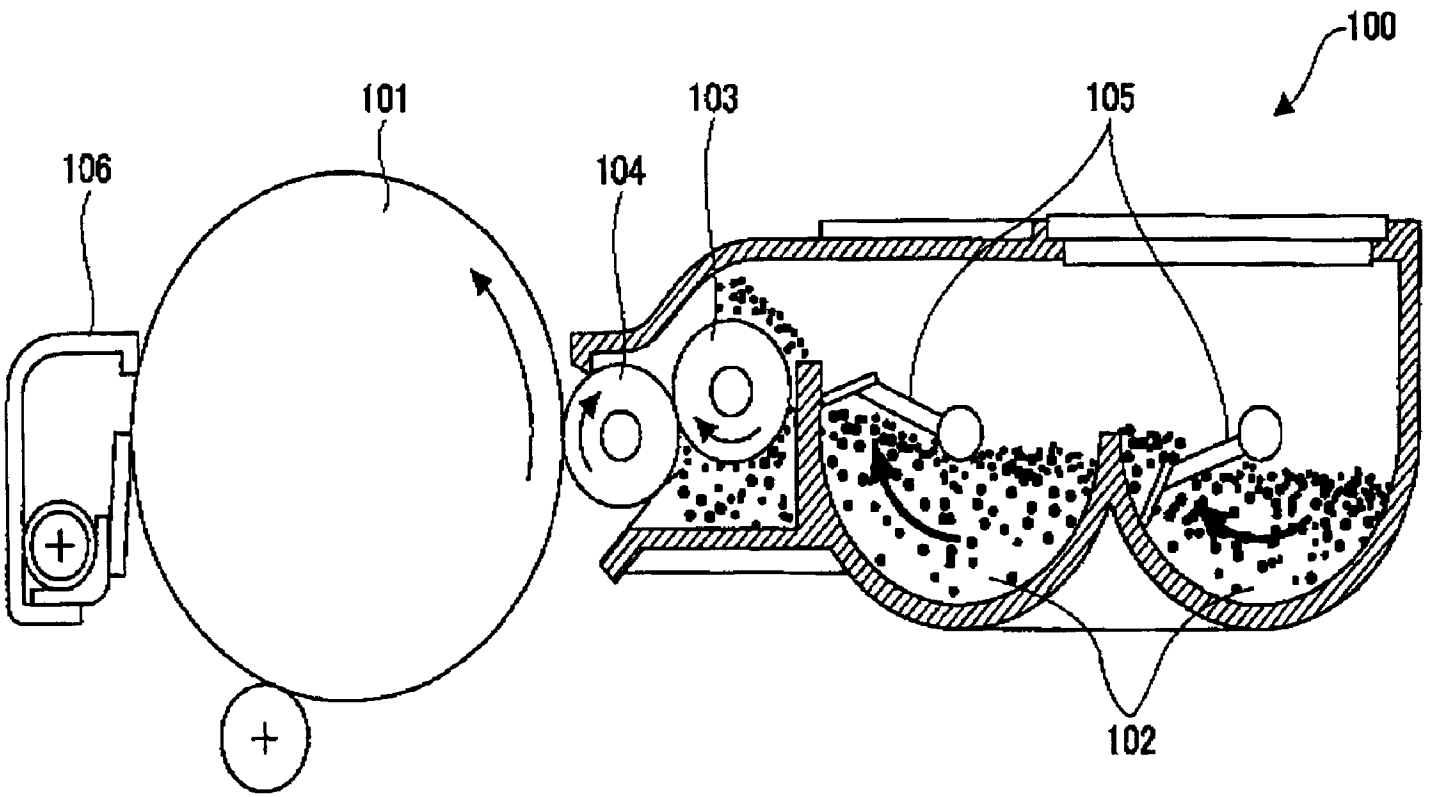
FIG. 2 is a view showing one example of a developing unit of the present invention.

In FIG. 2, the developing unit used in the present invention is shown together with the vicinity of the photoconductor 101. In the developing apparatus, the toner in a toner hopper 102 is supplied to the developing roller 104 by a resupply roller 103. The toner supplied to the developing roller 104 is charged by friction of the developing roller 104 with the thin layer forming member. The toner which was not consumed for the development is peeled from the developing roller by the resupply roller 103 to return in the toner hopper 102. Furthermore, an inside of the toner hopper 102 is agitated by an agitator 105 to keep the toner uniform. In FIG. 1, 106 indicates the cleaning unit.

The transfer can be performed by, for example, charging the photoconductor, and can be performed by the transferring unit. As the transferring unit, the aspect having a primary transferring unit which transfers the toner image onto an intermediate transferring member to form a transfer image and a secondary transferring unit which transfers the transfer image onto the recording medium is preferable. At that time, the aspect having the primary transferring unit which transfers the toner image using two colors or more, preferably full color toner as the toner onto the intermediate transferring member to form a composite transfer image and the secondary transferring unit which transfers the composite transfer image onto the recording medium is preferable.

The intermediate transferring member is not particularly limited, can be appropriately selected from transferring members known publicly, and suitably includes, for example a transfer belt.

It is preferable that the transferring unit (primary transferring unit, secondary transferring unit) has at least a transferring device which peels and charges the toner image formed on the photoconductor to a recording medium side. The transferring unit may be one or may be two or more. The transferring unit includes a corona transferring device by corona discharge, a transfer belt, a transfer roller, a pressure transfer roller and an adhesion transferring device.

The recording medium is typified by plain papers, but is not particularly limited, can be appropriately selected depending on the purpose, and PET bases for OHP can also be used.

The fixing can be performed using the fixing unit for the toner image transferred onto the recording medium. The toner image of each color may be fixed every transfer onto the recording medium, or the laminated toner images of respective colors may be fixed once simultaneously.

The fixing unit is not particularly limited, can be appropriately selected depending on the purpose, and publicly known heating and pressurizing units are suitable. The heating and pressurizing unit includes the combination of a heating roller with a pressurizing roller, and the combination of the heating roller, the pressurizing roller and an endless belt. A heating temperature by the heating and pressurizing unit is preferably 80° C. to 200° C.

In the present invention, depending on the purpose, a publicly known light fixing device may be used together with the fixing unit or in place thereof.

The electricity removal can be performed by applying an electricity removing bias to the photoconductor, and can be suitably performed by the electricity removing unit. The electricity removing unit is not particularly limited as long as the electricity removing bias can be applied to the photoconductor, can be appropriately selected from electricity removing devices known publicly, and suitably includes electricity removing lamps.

The cleaning can be suitably performed by, for example, removing the toner left on the photoconductor by the cleaning unit. The cleaning unit is not particularly limited, could be able to remove the toner left on the photoconductor, can be appropriately selected from publicly known cleaners, and suitably includes, for example, a magnetic brush cleaner, an electrostatic brush cleaner, a magnetic roller cleaner, a blade cleaner, a brush cleaner and a web cleaner.

The recycle can be suitably performed by feeding the toner removed by the cleaning unit to the developing unit by the recycling unit. The recycling unit is not particularly limited, and includes publicly known feeding units.

The control can be suitably performed by controlling each unit by the controlling unit. The controlling unit is not particularly limited as long as it can control each unit, can be appropriately selected depending on the purpose, and includes, for example, equipments such as sequencers and computers.

Figure 3:
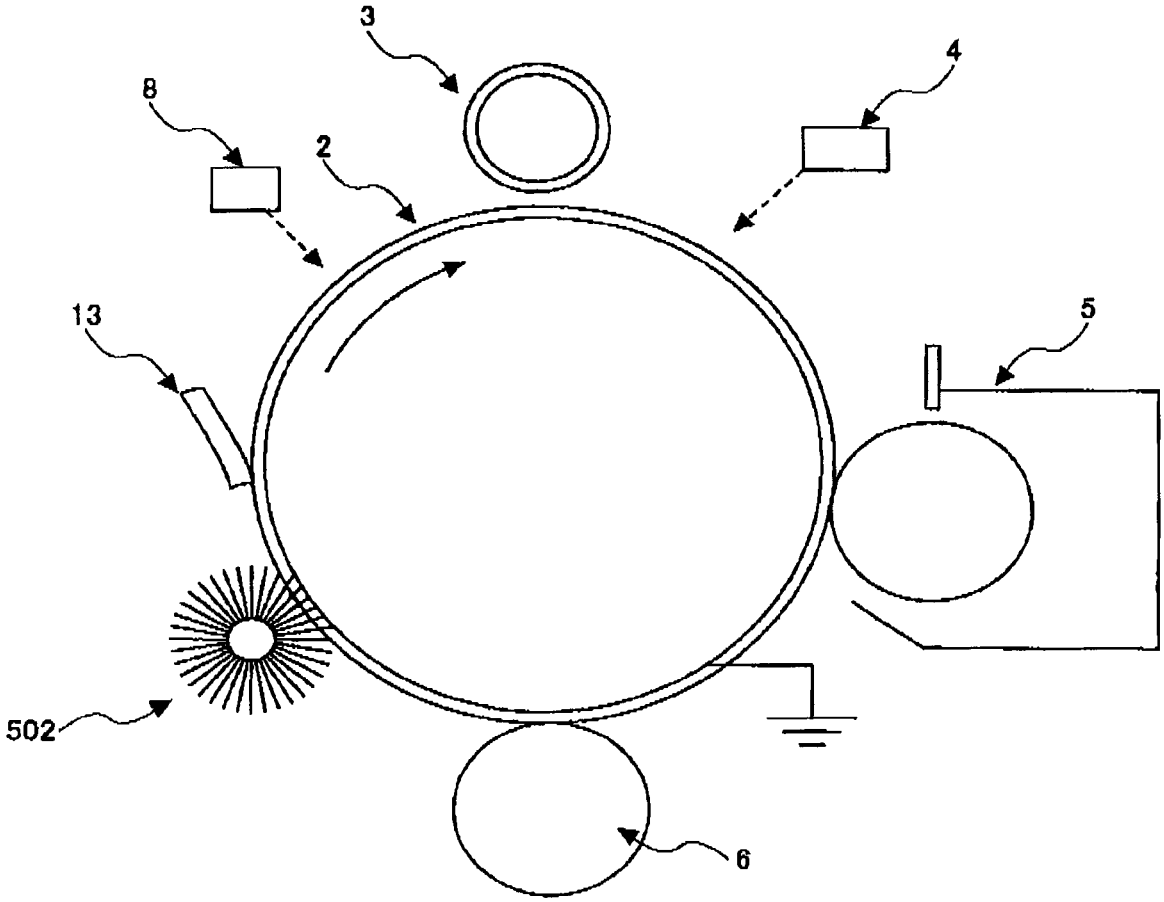
FIG. 3 is a view showing one example of an image forming apparatus of the present invention.

In FIG. 3, one example of the image forming apparatus of the present invention is shown. This image forming apparatus houses the photoconductor 2 rotated and driven in the clockwise direction in FIG. 3 in the main body housing not shown in the figure, and comprises the charging unit 3, the exposing unit 4, the developing unit 5, the transferring unit 6, the cleaning unit 13 and the electricity removing unit 8 around the photoconductor 2.

This image forming apparatus comprises a paper supply cassette (not shown in the figure) housing multiple papers. The recording paper in the paper supply cassette is sent out between the transferring unit 6 and the photoconductor 2 after controlling a timing one by one at resist roller pair not shown in the figure by a paper supply roller not shown in the figure.

In the image forming apparatus, the photoconductor 2 in FIG. 3 is rotated and driven in the clockwise direction to charge the photoconductor 2 evenly by the charging unit 3, the laser modulated by the image data is irradiated by the exposing unit to form the latent electrostatic image on the photoconductor 2, and the toner is adhered to the photoconductor 2 on which the latent electrostatic image has been formed to develop. Subsequently, the toner image is transferred onto the recording paper by feeding the recording paper between the photoconductor 2 on which the toner image has been formed in the developing unit and the transferring unit 6. Further, the recording paper on which the toner image has been formed is fed to the fixing unit (not shown in the figure).

The fixing unit comprises a fixing roller heated to a given fixing temperature by a built-in heater and a pressurizing roller pressed by the fixing roller with a given pressure, heats and pressurizes the recording paper fed from the transferring unit 6 to fix the toner image on the recording paper, and discharges the recording paper onto a paper discharge tray (not shown in the figure).

Meanwhile, in the image forming apparatus, the photoconductor 2 which has transferred the toner image onto the recording paper in the transferring unit 6 is further rotated, the toner left on the surface of the photoconductor 2 is scraped to remove by a blade in the cleaning unit 13, and the electricity is removed in the electricity removing unit 8. The image forming apparatus evenly charges the photoconductor 2 whose electricity has been removed by the electricity removing unit 8 by the charging unit 3, and then, the subsequent image formation is performed as is the case with the above. The cleaning unit 13 is not limited to one which scrapes the toner left on the photoconductor 2 by the blade, and may be one which scrapes the toner left on the photoconductor 2 by the fur brush 502.

EXAMPLES

The present invention will be described in more detail with reference to the following Examples and Comparative Examples, but the present invention is not limited thereto. The parts all mean the parts by weight.

Production Example 1 of Vinyl Based Copolymer Resin

In a reaction vessel equipped with a cooling tube, a stirrer and a nitrogen introducing tube, 1.6 parts of sodium dodecyl sulfate and 492 parts of ion exchange water were added, heated at 80° C., then 100 parts of ion exchange water dissolving 2.5 parts of potassium persulfate was added thereto, after 15 minutes, a mixed solution of 60 parts of styrene, 20 parts of butyl acrylate, 20 parts of methacrylic acid, 100 parts of p-styryl trimethoxysilane and 3.5 parts of n-octylmercaptan was dripped over 90 minutes, and kept at 80° C. for additional 60 minutes. Thereafter, the reaction was cooled to yield a dispersion of [vinyl based copolymer resin particles V1]. The average particle diameter of V1 was 65 nm. A small amount of the dispersion was taken in a dish and a dispersion medium was evaporated to yield a solid. The solid was measured, and consequently, the number average molecular weight was 11,000, the weight average molecular weight was 18,000 and Tg was 60° C.

Production Example 2 of Vinyl Based Copolymer Resin

In a reaction vessel equipped with a cooling tube, a stirrer and a nitrogen introducing tube, 1.6 parts of sodium dodecyl sulfate and 492 parts of ion exchange water were added, heated at 80° C., then 100 parts of ion exchange water dissolving 2.5 parts of potassium persulfate was added thereto, after 15 minutes, a mixed solution of 90 parts of styrene, 20 parts of methacrylic acid, 90 parts of 3-methacryloyloxypropyl trimethoxysilane and 3.5 parts of n-octylmercaptan was dripped over 90 minutes, and kept at 80° C. for additional 60 minutes. Thereafter, the reaction was cooled to yield a dispersion of [vinyl based copolymer resin particles V2]. The average particle diameter of V2 was 70 nm. A small amount of the dispersion was taken in a dish and a dispersion medium was evaporated to yield a solid. The solid was measured, and consequently, the number average molecular weight was 9,000, the weight average molecular weight was 15,000 and Tg was 50° C.

Production Example 3 of Vinyl Based Copolymer Resin

In a reaction vessel equipped with a cooling tube, a stirrer and a nitrogen introducing tube, 1.6 parts of sodium dodecyl sulfate and 492 parts of ion exchange water were added, heated at 80° C., then 100 parts of ion exchange water dissolving 2.5 parts of potassium persulfate was added thereto, after 15 minutes, a mixed solution of 70 parts of styrene, 30 parts of methacrylic acid, 60 parts of p-styryl trimethoxysilane, 40 parts of 3-methacryloyloxypropylmethyl dimethoxysilane and 3.5 parts of n-octylmercaptan was dripped over 90 minutes, and kept at 80° C. for additional 60 minutes. Thereafter, the reaction was cooled to yield a dispersion of [vinyl based copolymer resin particles V3]. The average particle diameter of V3 was 50 nm. A small amount of the dispersion was taken in a dish and a dispersion medium was evaporated to yield a solid. The solid was measured, and consequently, the number average molecular weight was 10,000, the weight average molecular weight was 16,000 and Tg was 58° C.

Production Example 4 of Vinyl Based Copolymer Resin

In a reaction vessel equipped with a cooling tube, a stirrer and a nitrogen introducing tube, 1.2 parts of sodium dodecyl sulfate and 492 parts of ion exchange water were added, heated at 80° C., then 100 parts of ion exchange water dissolving 2.5 parts of potassium persulfate was added thereto, after 15 minutes, a mixed solution of 154 parts of styrene, 30 parts of butyl acrylate, 16 parts of methacrylic acid, and 2.4 parts of n-octylmercaptan was dripped over 90 minutes, and kept at 80° C. for additional 60 minutes. Thereafter, the reaction was cooled to yield a dispersion of [vinyl based copolymer resin particles V4]. The average particle diameter of V4 was 90 nm. A small amount of the dispersion was taken in a dish and a dispersion medium was evaporated to yield a solid. The solid was measured, and consequently, the number average molecular weight was 13,000, the weight average molecular weight was 24,000 and Tg was 68° C.

Production Example 5 of Vinyl Based Copolymer Resin

In a reaction vessel equipped with a cooling tube, a stirrer and a nitrogen introducing tube, 1.6 parts of sodium dodecyl sulfate and 492 parts of ion exchange water were added, heated at 80° C., then 100 parts of ion exchange water dissolving 2.5 parts of potassium persulfate was added thereto, after 15 minutes, a mixed solution of 60 parts of styrene, 20 parts of butyl acrylate, 20 parts of methacrylic acid, 100 parts of trimethylsilyl and 3.5 parts of n-octylmercaptan was dripped over 90 minutes, and kept at 80° C. for additional 60 minutes. Thereafter, the reaction was cooled to yield a dispersion of [vinyl based copolymer resin particles V5]. The average particle diameter of V5 was 66 nm. A small amount of the dispersion was taken in a dish and a dispersion medium was evaporated to yield a solid. The solid was measured, and consequently, the number average molecular weight was 11,000, the weight average molecular weight was 18,000 and Tg was 60° C.

Production Example 1 of Solution of Vinyl Based Copolymer Resin in Ethyl Acetate A water dispersion (200 g) of the vinyl based copolymer resin particles V1 prepared in the above Production Example 1 of the vinyl based copolymer resin particles was placed in a regenerated cellulose dialysis tube (Spectra/Por supplied from Spectrum, fractionation molecular weight 3,500, diameter 34 mm), and immersed in a 10 L vessel in which ion exchange water is run with overflow for 24 hours. Then, the resin particles were reprecipitated in 5 L of ethanol and filtrated, and subsequently a solution X1 of 25% by weight vinyl based copolymer resin in ethyl acetate was prepared.

Production Example 2 of Solution of Vinyl Based Copolymer Resin in Ethyl Acetate The vinyl based copolymer resin particles V2 were treated in the same way as in Production Example 1 of the solution X1 of vinyl based copolymer resin in ethyl acetate to yield a solution X2 of 25% by weight vinyl based copolymer resin in ethyl acetate.

Production Example 1 of Master Batch

Legal 400R of carbon black (40 parts) (supplied from Cabot), 60 parts of polyester resin RS-801 (supplied from Sanyo Chemical Industries, Ltd.) (acid value: 10 mg KOH/g, Mw: 20,000, Tg: 64° C.) and 30 parts of water were mixed using Henschel mixer to yield a mixture in which water had been impregnated in pigment aggregate. This was kneaded for 45 minutes using two rolls whose surface temperature had been set at 130° C. and pulverized to a size of the average particle diameter of 1 mm using a pulverizer to yield a [master batch 1].

Production Example 2 of Master Batch

C.I. pigment blue 15:3 (40 parts), 60 parts of polyester resin RS-801 (supplied from Sanyo Chemical Industries, Ltd.) and 30 parts of water were mixed using Henschel mixer to yield a mixture in which water had been impregnated in pigment aggregate. This was kneaded for 45 minutes using two rolls whose surface temperature had been set at 130° C. and pulverized to a size of the average particle diameter of 1 mm using a pulverizer to yield a [master batch 2].

Production Example 3 of Master Batch

C.I. pigment red 57:1 (40 parts), 60 parts of polyester resin RS-801 (supplied from Sanyo Chemical Industries, Ltd.) and 30 parts of water were mixed using Henschel mixer to yield a mixture in which water had been impregnated in pigment aggregate. This was kneaded for 45 minutes using two rolls whose surface temperature had been set at 130° C. and pulverized to a size of the average particle diameter of 1 mm using a pulverizer to yield a [master batch 3].

Production Example 4 of Master Batch

C.I. pigment yellow 180 (40 parts), 60 parts of polyester resin RS-801 (supplied from Sanyo Chemical Industries, Ltd.) and 30 parts of water were mixed using Henschel mixer to yield a mixture in which water had been impregnated in pigment aggregate. This was kneaded for 45 minutes using two rolls whose surface temperature had been set at 130° C. and pulverized to a size of the average particle diameter of 1 mm using a pulverizer to yield a [master batch 4].

Example 1

In a reaction vessel equipped with a cooling tube, a stirrer and a nitrogen introducing tube, 682 parts of bisphenol A ethylene oxide 2 mol adduct, 81 parts of bisphenol A propylene oxide 2 mol adduct, 283 parts of terephthalic acid, 22 parts of trimellitic acid anhydrate and 2 parts of dibutyl tin oxide were placed, reacted under atmospheric pressure at 230° C. for 8 hours, and further reacted under reduced pressure of 10 mmHg to 15 mmHg for 5 hours to yield an [intermediate polyester 1]. The [intermediate polyester 1] had the number average molecular weight of 2,100, the weight average molecular weight of 9,500, Tg of 55° C., the acid value of 0.5 mg KOH/g and the hydroxyl group value of 49 mg KOH/g.

Subsequently, in a reaction vessel equipped with a cooling tube, a stirrer and a nitrogen introducing tube, 411 parts of the [intermediate polyester 1], 89 parts of isophorone diisocyanate and 500 parts of ethyl acetate were placed, and reacted at 100° C. for 5 hours to yield a [prepolymer 1]. The amount of free isocyanate in the [prepolymer 1] was 1.53% by weight.

In a reaction vessel equipped with a cooling tube, a stirrer and a nitrogen introducing tube, 220 parts of bisphenol A ethylene oxide 2 mol adduct, 561 parts of bisphenol A propylene oxide 2 mol adduct, 218 parts of terephthalic acid, 48 parts of adipic acid and 2 parts of dibutyl tin oxide were placed, reacted under atmospheric pressure at 230° C. for 8 hours, and further reacted under reduced pressure of 10 mmHg to 15 mmHg for 5 hours. Subsequently, 45 parts of trimellitic acid anhydrate was added to the reaction vessel, and the mixture was reacted under atmospheric pressure at 180° C. for 2 hours to yield [polyester 1]. The [polyester 1] had the weight average molecular weight of 4,000, Tg of 483° C., the acid value of 25 mg KOH/g In a vessel equipped with a stirring bar and a thermometer, 543.5 parts of the [polyester 1], 181 parts of paraffin wax, and 1450 parts of ethyl acetate were placed, the mixture was heated at 80° C. with stirring, kept at 80° C. for 5 hours and cooled to 30° C. over one hour. Then, 500 parts of the [master batch 2] and 100 parts of ethyl acetate were placed in the vessel and mixed for one hour to yield a [raw material solution 1].

The [raw material solution 1] (1500 parts) was transferred to a vessel, using Ultraviscomill which was a bead mill (supplied from Imex), 80% by volume was filled with zirconia beads having the particle diameter of 0.5 mm, and the cyan pigment and the wax were dispersed under the condition of a liquid sending speed of 1 kg/hour, a disc peripheral speed of 6 m/second and three passes. Subsequently, 655 parts of the solution of 65% by weight [polyester 1] in ethyl acetate was added and one pass was given in the above bead mill to yield a [pigment wax dispersion 1]. The [pigment wax dispersion 1] was adjusted by adding ethyl acetate so that the solid concentration (measurement condition: 130° C., 30 minutes) was 50% by weight.

Ion exchange water (968 parts), 40 parts of a water-based dispersion of 25% by weight resin fine particles (copolymer of sodium salt of styrene-methacrylic acid-butyl acrylate-methacrylic acid ethylene oxide adduct sulfate ester), 150 parts of Eleminol MON-7 (supplied from Sanyo Chemical Industries, Ltd.), an aqueous solution of 48.5% by weight sodium dodecyldiphenyl ether sulfonate, and 98 parts of ethyl acetate were mixed and stirred to yield a milk white liquid. This is rendered an [aqueous phase 1].

The [pigment wax dispersion 1] (976 parts) and 2.6 parts of isophorone diamine as the amines were mixed at 5,000 rpm for one minutes using T.K. Homomixer (supplied from Tokushu Kika Kogyo Co., Ltd.), subsequently 88 parts of the [prepolymer 1] was added, and the mixture was mixed at 5,000 rpm for one minutes using T.K. Homomixer (supplied from Tokushu Kika Kogyo Co., Ltd.). Further, 1200 parts of the [aqueous phase 1] was added thereto, which was then mixed at 8,000 rpm to 13,000 rpm for 15 minutes using T.K. Homomixer to yield an [emulsified slurry 1].

In a vessel equipped with a stirrer and a thermometer, the [emulsified slurry 1] was placed, and dissolvent was performed at 30° C. for 8 hours to yield a [dispersion slurry 1].

To the [dispersion slurry 1], the dispersion of the [vinyl based copolymer resin particles V1] was added at a solid ratio of 1:0.12, which was then heated up to 73° C. over 30 minutes. A solution in which 100 parts of magnesium chloride hexahydrate had been dissolved in 100 parts of ion exchange water was added in small portions and the temperature was kept at 70° C. After 4 hours, an aqueous solution of hydrochloric acid was added to adjust pH to pH 5, the mixture was heated to 80° C., and after 2 hours, the mixture was cooled to yield a [dispersion slurry 1A].

After filtrating 100 parts of the [dispersion slurry 1A] under reduced pressure, (1) Ion exchange water (100 parts) was added to a filtrated cake, which was then mixed (at 12,000 rpm for 10 minutes) using T.K. Homomixer, and subsequently filtrated.

(2) Ion exchange water (900 parts) was added to a filtrated cake of (1), which was then mixed (at 12,000 rpm for 10 minutes) using T.K. Homomixer, and subsequently filtrated under reduced pressure. This manipulation was repeated until an electric conductivity of re-slurry solution became 10 μS/cm or less.

(3) 10% By weight hydrochloric acid was added so that pH of the re-slurry solution of (2) was pH 4, and the re-slurry solution was stirred as it was using a three one motor, and after 30 minutes filtrated.

(4) Ion exchange water (100 parts) was added to a filtrated cake of (3), which was then mixed (at 12,000 rpm for 10 minutes) using T.K. Homomixer, and subsequently filtrated. This manipulation was repeated until the electric conductivity of re-slurry solution became 10 μS/cm or less to yield a [filtrated cake 1].

The [filtrated cake 1] was dried using a fair wind dryer at 45° C. for 48 hours and sieved with mesh having opening of 75 μm to yield [base particles 1]. The volume average particle diameter (Dv) was 7.2 μm, the number average particle diameter (Dp) was 6.2 μm, Dv/Dp was 1.16, the average circularity was 0.973 and the film thickness of the shell material was 0.13 μm. Subsequently, 100 parts of the [base particles 1], 1.0 part of hydrophobic silica H20TM (supplied from Clariant) and 0.5 parts of hydrophobic silica NX90 (supplied from Nippon Aerosil) were mixed using Henschel mixer to yield non-magnetic toner.

Example 2

Non-magnetic toner was obtained in the same way as in Example 1, except that V2 was used as the vinyl based copolymer resin particle. The volume average particle diameter (Dv) was 6.8 μm, the number average particle diameter (Dp) was 6.0 μm, Dv/Dp was 1.13, the average circularity was 0.978 and the film thickness of the shell material was 0.12 μm.

Example 3

Non-magnetic toner was obtained in the same way as in Example 1, except that V3 was used as the vinyl based copolymer resin particle. The volume average particle diameter (Dv) was 7 μm, the number average particle diameter (Dp) was 6.5 μm, Dv/Dp was 1.14, the average circularity was 0.972 and the film thickness of the shell material was 0.14 μm.

Example 4

Non-magnetic toner was obtained in the same way as in Example 1, except that to the [dispersion slurry 1], the dispersion of the [vinyl based copolymer resin particles V1] was added at a solid ratio of 1:0.05. The volume average particle diameter (Dv) was 7.1 μm, the number average particle diameter (Dp) was 6.5 μm, Dv/Dp was 1.09, the average circularity was 0.980 and the film thickness of the shell material was 0.05 μm.

Example 5

Non-magnetic toner was obtained in the same way as in Example 1, except that to the [dispersion slurry 1], the dispersion of the [vinyl based copolymer resin particles V1] was added at a solid ratio of 1:0.24. The volume average particle diameter (Dv) was 7.3 μm, the number average particle diameter (Dp) was 6.1 μm, Dv/Dp was 1.20, the average circularity was 0.968 and the film thickness of the shell material was 0.26 μm.

Example 6

Non-magnetic toner was obtained in the same way as in Example 1, except that to the [dispersion slurry 1], the dispersion of the [vinyl based copolymer resin particles V1] was added at a solid ratio of 1:0.12. The volume average particle diameter (Dv) was 5.3 μm, the number average particle diameter (Dp) was 4.8 μm, Dv/Dp was 1.10, the average circularity was 0.981 and the film thickness of the shell material was 0.10 μm.

Example 7

Non-magnetic toner was obtained in the same way as in Example 1, except that the amount of Eleminol MON-7 (supplied from Sanyo Chemical Industries, Ltd.) was changed to 100 parts. The volume average particle diameter (Dv) was 9.6 μm, the number average particle diameter (Dp) was 8.4 μm, Dv/Dp was 1.14, the average circularity was 0.973 and the film thickness of the shell material was 0.17 μm.

Example 8

Non-magnetic toner was obtained in the same way as in Example 1, except that the [master batch 1] was changed to the [master batch 2] and to the [dispersion slurry 1], the dispersion of the [vinyl based copolymer resin particles V1] was added at a solid ratio of 1:0.1 thereby to yield [base particles 8]; then 100 parts of the [base particles 8], 0.2 part of hydrophobic silica H20TM (supplied from Clariant) and 0.5 part of salicylic acid-based metal complex E-84 (supplied from Orient Chemical Industries Ltd.) were mixed by use of Q mixer to prepare [base particles 8A]; then 100 parts of [base particles 8A], 1.0 part of hydrophobic silica H20TM (supplied from Clariant) and 0.5 parts of hydrophobic silica NX90 (supplied from Nippon Aerosil) were mixed by use of Henschel mixer. The volume average particle diameter (Dv) was 7.5 μm, the number average particle diameter (Dp) was 6.5 μm, Dv/Dp was 1.15, the average circularity was 0.972 and the film thickness of the shell material was 0.12 μm.

Example 9

Non-magnetic toner was obtained in the same way as in Example 1, except that the [master batch 1] was changed to the [master batch 3] and V2 was used as the vinyl based copolymer resin particles. The volume average particle diameter (Dv) was 7.0 μm, the number average particle diameter (Dp) was 6.2 μm, Dv/Dp was 1.13, the average circularity was 0.978 and the film thickness of the shell material was 0.11 μm.

Example 10

Non-magnetic toner was obtained in the same way as in Example 1, except that the [master batch 1] was changed to the [master batch 4] and V3 was used as the vinyl based copolymer resin particles. The volume average particle diameter (Dv) was 7.6 μm, the number average particle diameter (Dp) was 6.5 μm, Dv/Dp was 1.17, the average circularity was 0.971 and the film thickness of the shell material was 0.12 μm.

Example 11

Non-magnetic toner was obtained in the same way as in Example 1, except that to the [dispersion slurry 1], the dispersion of the [vinyl based copolymer resin particles V1] was added at a solid ratio of 1:0.01. The volume average particle diameter (Dv) was 7.3 μm, the number average particle diameter (Dp) was 6.2 μm, Dv/Dp was 1.18, the average circularity was 0.967 and the film thickness of the shell material was 0.01 μm.

Example 12

Non-magnetic toner was obtained in the same way as in Example 1, except that to the [dispersion slurry 1], the dispersion of the [vinyl based copolymer resin particles V1] was added at a solid ratio of 1:0.5 and after adjusting pH to 5, heating at 80° C. was performed and after 4 hours, cooling was performed. The volume average particle diameter (Dv) was 8.1 μm, the number average particle diameter (Dp) was 6.5 μm, Dv/Dp was 1.25, the average circularity was 0.987 and the film thickness of the shell material was 0.49 μm.

Example 13

Non-magnetic toner was obtained in the same way as in Example 1, except that to the [dispersion slurry 1], the dispersion of the [vinyl based copolymer resin particles V1] was added at a solid ratio of 1:0.12 and after adjusting pH to 5, the temperature at 80° C. was kept and after 2 hours, cooling was performed. The volume average particle diameter (Dv) was 7.4 μm, the number average particle diameter (Dp) was 5.8 μm, Dv/Dp was 1.28, the average circularity was 0.951 and the film thickness of the shell material was 0.11 μm.

Example 14

Non-magnetic toner was obtained in the same way as in Example 1, except that upon production of the [emulsified slurry], the solution X1 of 25% by weight vinyl based copolymer resin particles in ethyl acetate was added at a solid ratio of 1:0.12 and only 100 parts of ion exchange water was added to the [dispersion slurry 1] and heated. The volume average particle diameter (Dv) was 7.0 μm, the number average particle diameter (Dp) was 5.9 μm, Dv/Dp was 1.19 and the average circularity was 0.978. The vinyl based copolymer resin dissolved in X1 was observed as well as the film thickness measurement, consequently it formed the almost even shell material and its film thickness was 0.12 μm.

Example 15

Non-magnetic toner was obtained in the same way as in Example 14, except that the solution X2 of 25% by weight vinyl based copolymer resin particles in ethyl acetate was used. The volume average particle diameter (Dv) was 7.5 μm, the number average particle diameter (Dp) was 6.4 μm, Dv/Dp was 1.17, the average circularity was 0.976 and the film thickness of the shell material was 0.13 μm, which was the almost even shell material.

Comparative Example 1

Non-magnetic toner was obtained in the same way as in Example 1, except that V4 was used as the vinyl based copolymer resin particles. The volume average particle diameter (Dv) was 7.4 μm, the number average particle diameter (Dp) was 6.5 μm, Dv/Dp was 1.14, the average circularity was 0.971 and the film thickness of the shell material was 0.13 μm.

Comparative Example 2

Non-magnetic toner was obtained in the same way as in Example 1, except that the [dispersion slurry 1] was used in place of the [dispersion slurry 1A]. The volume average particle diameter (Dv) was 7.6 μm, the number average particle diameter (Dp) was 6.5 μm, Dv/Dp was 1.17, the average circularity was 0.975 and the shell material was not observed.

Comparative Example 3

Non-magnetic toner was obtained in the same way as in Example 1, except that V5 was used as the vinyl based copolymer resin particles. The volume average particle diameter (Dv) was 7.5 μm, the number average particle diameter (Dp) was 6.5 μm, Dv/Dp was 1.15, the average circularity was 0.974 and the film thickness of the shell material was 0.14 μm.

(Evaluation Methods and Evaluation Results)

Using a remodeling machine obtained by setting a line speed of the fixing belt to 125 mm/second and setting the temperature of the fixing belt to 170° C. in the fixing section of IPSIO CX2500 (supplied from Ricoh co., Ltd.), a given printing pattern with B/W ratio of 5% was continuously printed using the non-magnetic toner under a high temperature and high humidity environment (H/H:30° C. and 80% RH) and a low temperature and low humidity environment (L/L: 10° C. and (15% RH).

(Durability)

(a) Charge Amount

After continuously printing 50 sheets or 2,000 sheets under the H/H or L/L environment, the toner on the developing roller during printing a white paper pattern was aspirated, the charge amount was measured using an electrometer, and a charge amount difference ΔQ between after printing 50 sheets and 2,000 sheets was evaluated.

A: absolute value of ΔQ is less than 10 μC/g;

B: absolute value of ΔQ is 10 μC/g or more and less than 15 μC/g; and

C: absolute value of ΔQ is 15 μC/g or more.

(b) Back Ground Smear

After continuously printing 2,000 sheets under the H/H or L/L environment, ΔE of back ground smear was obtained by a tape transfer method. The tape transfer method is the method in which a mending tape (supplied from Sumitomo 3M Ltd.) is attached on the toner present on the photoconductor to transfer the fog toner onto the tape, this tape and the tape before attaching are attached on white paper, reflection density of them is measured using X-Rite 939, and their difference ΔE is calculated as the reflection density of the back ground smear.

A: absolute value of ΔE is less than 3;

B: absolute value of ΔE is 3 or more and less than 6; and

C: absolute value of ΔE is 6 or more.

(Fixing Separability)

After continuously printing 2,000 sheets under the H/H environment, fixing separability was evaluated. A separable/non-offset temperature range was obtained by fixing transfer paper from 4 mm of a tip margin at every 10° C. in the range of the temperature at 140° C. to 190° C. of the fixing belt after continuously printing 2,000 sheets. The temperature range means a fixing temperature range in which the paper is separated well from the heating roller as well as no offset phenomenon occurs.

A: separable/non-offset temperature range was 50° C. or above.

B: separable/non-offset temperature range was 30° C. or above and lower than 50° C.

C: separable/non-offset temperature range was lower than 30° C.

The above evaluation results are shown in Table 1.

TABLE 1

| | Durability evaluation LL | | | | |
|---|---|---|---|---|---|
| | Charge amount (μQ/g) | | | | back ground smear |
| | 50 sheets | 2000 sheets | ΔQ | | ΔE |
| Example 1 | 35.2 | 29.4 | 5.8 | A | 1.6 |
| Example 2 | 39.3 | 34.1 | 5.2 | A | 1.3 |
| Example 3 | 36.6 | 29.2 | 7.4 | A | 0.9 |
| Example 4 | 33.1 | 26.2 | 6.9 | A | 2.1 |

TABLE 1-continued

| | | | | | |
|---|---|---|---|---|---|
| Example 5 | 37.8 | 30.4 | 7.4 | A | 1.0 |
| Example 6 | 42.9 | 33.7 | 9.2 | A | 2.2 |
| Example 7 | 30.4 | 23.9 | 6.5 | A | 1.1 |
| Example 8 | 41.2 | 32.5 | 8.7 | A | 0.7 |
| Example 9 | 44.3 | 36.2 | 8.1 | A | 1.2 |
| Example 10 | 43.7 | 36.5 | 7.2 | A | 1.8 |
| Example 11 | 32.6 | 20.8 | 11.8 | B | 3.9 |
| Example 12 | 36.1 | 27.9 | 8.2 | A | 1.6 |
| Example 13 | 39.1 | 29.7 | 9.4 | A | 2.1 |
| Example 14 | 36.3 | 30.8 | 5.5 | A | 1.5 |
| Example 15 | 38.1 | 33.2 | 4.9 | A | 1.4 |
| Comparative Example 1 | 30.1 | 18.1 | 12.0 | B | 4.4 |
| Comparative Example 2 | 28.2 | 12.7 | 15.5 | C | 6.5 |
| Comparative Example 3 | 34.5 | 18.8 | 15.7 | C | 6.3 |

| | Durability evaluation HH | | | | | | |
|---|---|---|---|---|---|---|---|
| | Charge amount (μQ/g) | | | | back ground | back ground | Fixing |
| | 50 sheets | 2000 sheets | ΔQ | | smear ΔE | smear total | separability evaluation |
| Example 1 | 21.4 | 15.3 | 6.1 | A | 1.2 | A | A |
| Example 2 | 23.5 | 18.0 | 5.5 | A | 0.9 | A | A |
| Example 3 | 23 | 16.6 | 6.4 | A | 1.3 | A | A |
| Example 4 | 20.9 | 13.2 | 7.7 | A | 1.9 | A | A |
| Example 5 | 19.1 | 14.8 | 4.3 | A | 1.3 | A | A |
| Example 6 | 27.8 | 19.2 | 8.6 | A | 2.1 | A | A |
| Example 7 | 17.9 | 11.7 | 6.2 | A | 1.7 | A | A |
| Example 8 | 20.8 | 16.3 | 4.5 | A | 0.9 | A | A |
| Example 9 | 26.4 | 19.7 | 6.7 | A | 1.1 | A | A |
| Example 10 | 23.2 | 19 | 4.2 | A | 1.6 | A | A |
| Example 11 | 18.7 | 9.6 | 9.1 | A | 4.5 | B | A |
| Example 12 | 20.2 | 16.1 | 4.1 | A | 1.7 | A | B |
| Example 13 | 22.0 | 15.8 | 6.2 | A | 1.9 | A | A |
| Example 14 | 22.0 | 16.1 | 5.9 | A | 1.2 | A | A |
| Example 15 | 23.8 | 18.2 | 5.6 | A | 1.1 | A | A |
| Comparative Example 1 | 17.4 | 7.7 | 9.7 | A | 8.3 | C | A |
| Comparative Example 2 | 16.8 | 6.5 | 10.3 | B | 7.4 | C | A |
| Comparative Example 3 | 18.5 | 9.2 | 9.3 | A | 5.2 | C | A |

High temperature and high humidity environment (H/H:30° C. and 80% RH)

Low temperature and low humidity environment (L/L:10° C. and (16% RH)

Here, A, B and C in the back ground smear (Total) were obtained by three point scale evaluation as the total evaluation of the back ground smear, and A, B and C indicate a good level, a practically no problematic level and a practically problematic level, respectively.

In Example 11, the change of the charge amounts became large and the back ground smear was reduced. This is thought to be because the charge amount distribution was widened. In Example 12, the fixing separability at higher temperature was reduced. Meanwhile in Comparative Example 1, the back ground smear under the H/H environment was deteriorated. In Comparative Example 2, the change of the charge amounts became large and the back ground smear was deteriorated. Furthermore, in Comparative Example 3, the change of the charge amounts became large and the back ground smear was deteriorated particularly under the L/L environment.

As in the above, using the toner of the present invention, the charge property in durability and the stability of the charge amount distribution can be assured, and the stable fixing separability and the image quality can be obtained.

What is claimed is:

1. A non-magnetic toner comprising:

a toner base particle which comprises a binding resin, and a colorant; and external additives, wherein a surface of the toner base particle contains at least a resin having at least silanol group, and the external additives contain at least particles composed of silicon oxide.

2. The non-magnetic toner according to claim 1, wherein the surface of said toner base particle is formed by aggregating and/or heating said particles containing the resin having at least the silanol group.

3. The non-magnetic toner according to claim 1, wherein said toner base particle has a core material containing at least the colorant and a first binding resin, and a shell material covering the core material and composed of a second binding resin, and wherein the second binding resin contains at least said resin having at least the silanol group.

4. The non-magnetic toner according to claim 1, wherein said silanol group is obtained by chemically treating a functional group represented by a general formula:

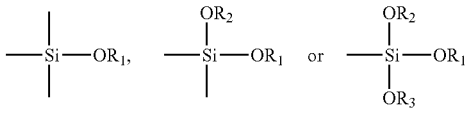

wherein $R_1$, $R_2$ and $R_3$ are each independently hydrocarbon groups selected from the group consisting of branched or straight alkyl groups having 1 to 6 carbon atoms, alicyclic groups having 3 to 6 carbon atoms and substituted or unsubstituted phenyl groups.

5. The non magnetic toner according to claim 4, wherein in said shell material, thickness of shell layer is 20 nm or more and 300 nm or less, a volume average particle diameter is 4 μm or more and 10 μm or less, and an average circularity is 0.910 or more and 0.990 or less.

6. The non-magnetic toner according to claim 4, wherein said first binding resin contains polyester resin having a glass transition temperature of 40° C. or above and 80° C. or below.

7. The non-magnetic toner according to claim 4, wherein said first binding resin contains modified polyester resin.

8. The non-magnetic toner according to claim 7, wherein said modified polyester resin has urethane group and/or urea group.

9. The non-magnetic toner according to claim 4, wherein said first binding resin contains a resin obtained by reacting the polyester resin having isocyanate group at an end with amines.

10. The non-magnetic toner according to claim 1, wherein said toner base particle has a surface tension of 30 mN/m or more and 60 mN/m or less.

11. The non-magnetic toner according to claim 1, wherein said toner base particle is obtained by at least being granulated using an organic solvent in a water-based medium and subsequently removing the organic solvent.

12. The non-magnetic toner according to claim 1, further containing a releasing agent.

13. The non-magnetic toner according to claim 1, used for a one-component development system.

14. An image forming apparatus, wherein an image is formed using non-magnetic toner comprising:

a toner base particle which comprises a binding resin, and a colorant; and external additives wherein a surface of the toner base particle contains at least a resin having at least silanol group, and the external additives contain at least particles composed of silicon oxide.

15. The image forming apparatus according to claim 14, wherein a multicolor image is formed.

16. The image forming apparatus according to claim 14, having an endless type of an intermediate transferring unit.

17. The image forming apparatus according to claim 16, having a photoconductor and a cleaning unit which cleans the toner left on the photoconductor and/or said intermediate transferring unit, wherein the cleaning unit has no cleaning blade.

18. The image forming apparatus according to claim 16, having a photoconductor and a cleaning unit which cleans the toner left on the photoconductor and/or said intermediate transferring unit, wherein the cleaning unit has a cleaning blade.

19. The image forming apparatus according to claim 14, having a fixing unit which requires no oil application for a fixing member.

20. A process cartridge integrally supporting a photoconductor and a developing unit which develops using a non-magnetic toner comprising:

a toner base particle which comprises a binding resin, and a colorant; and external additives, wherein a surface of the toner base particle contains at least a resin having at least silanol group, and the external additives contain at least particles composed of silicon oxide;

and being detachable to an image forming apparatus main body.

* * * * *